US007019709B2

(12) United States Patent
Fukushima et al.

(10) Patent No.: US 7,019,709 B2
(45) Date of Patent: Mar. 28, 2006

(54) ANTENNA DEVICE

(75) Inventors: Susumu Fukushima, Osaka (JP); Yuji Osumi, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 234 days.

(21) Appl. No.: 10/644,732

(22) Filed: Aug. 21, 2003

(65) Prior Publication Data

US 2004/0095282 A1 May 20, 2004

(30) Foreign Application Priority Data

Aug. 22, 2002 (JP) ..... 2002-241424
Aug. 23, 2002 (JP) ..... 2002-243068
Aug. 29, 2002 (JP) ..... 2002-250899

(51) Int. Cl.
*H01Q 1/36* (2006.01)
*H01Q 21/24* (2006.01)

(52) U.S. Cl. ..... 343/846; 343/700 MS

(58) Field of Classification Search ..... 343/700 MS, 343/830, 846
See application file for complete search history.

(56) References Cited

U.S. PATENT DOCUMENTS 5,061,943 A * 10/1991 Rammos ..... 343/770
5,216,430 A * 6/1993 Rahm et al. ..... 343/700 MS
5,661,494 A * 8/1997 Bondyopadhyay ... 343/700 MS

* cited by examiner

*Primary Examiner*—Michael C. Wimer
(74) *Attorney, Agent, or Firm*—Wenderoth, Lind & Ponack, L.L.P.

(57) ABSTRACT

An antenna device has a first radiation plate and a second radiation plate of which a diameter or one side is about ½ wavelength in electrical length disposed on a ground plate at an arbitrary interval. A first power feed port and a second power feed port are provided on the first radiation plate and are disposed so that straight lines linking each power feed port position and a middle point of the first radiation plate may be orthogonal to each other. A third power feed port and a fourth power feed port are provided on the second radiation plate and are disposed so that straight lines linking each power feed port position and a middle point of the second radiation plate may be orthogonal to each other. The straight lines are disposed to have an angle of 45 degrees to a straight line linking the first power feed port position and the middle point of the first radiation plate and to a straight line linking the second power feed port position and the middle point of the first radiation plate.

34 Claims, 25 Drawing Sheets

ANTENNA DEVICE

FIELD OF THE INVENTION

The present invention relates to an antenna device such as a diversity antenna used in mobile communications.

BACKGROUND OF THE INVENTION

Hitherto, in a long-distance wireless transmission route, for example, reception level fluctuates significantly depending on place, time and polarization, generally, due to the occurrence of fading, and it has been attempted to prevent fluctuations of reception level by employing diversity technology. Conventional diversity antennas are shown in FIG. 30A and FIG. 30B.

FIG. 30A shows a space diversity antenna having four monopole antennas 101 disposed perpendicularly on a ground plate 100 at a specific interval. In each monopole antenna 101, received signal levels are compared, and the higher one is selected, and deep attenuation of reception signal caused depending on place of reception or the like can be lessened. To enhance the effect of space diversity, it is required to lower the correlation coefficient by extending the mutual distance of antennas.

FIG. 30B shows a directive diversity antenna having a first dipole antenna 102 and a second dipole antenna 103 disposed orthogonally so that the directivity of each antenna may cross orthogonally. Since fading occurs in every polarized wave, in one place, for example, a vertical polarized wave is not received at all while a horizontal polarized wave is received by a large reception power. In such a case, by using a directive diversity antenna, deep attenuation of reception power can be lessened.

However, when the space diversity antenna in FIG. 30A is applied in a mobile terminal, it is extremely difficult to keep a specific distance among antennas in the recent downsizing trend of mobile terminals. In a small portable terminal, if antennas are closely disposed to each other to realize a space diversity, since the directivity pattern on the horizontal plane of each monopole antenna 101 in FIG. 30A is nondirectional, arbitrary incoming waves are similarly received by the antennas and it is highly possible that the reception voltages of the antennas be identical, and the correlation coefficient of the monopole antennas may deteriorate significantly.

Or, when the directive diversity antennas in FIG. 30B are disposed parallel to each other on the ground, the bandwidth becomes narrow, and the antenna gain deteriorates extremely. It is hence difficult to mount the antennas on the ground, which is the basic requirement for realizing incorporation of an antenna in a small portable terminal, and directive diversity may not be realized in a small portable terminal. Besides, since the antenna is made of a metal element, it is hard to retain the shape and is likely to be broken.

SUMMARY OF THE INVENTION

The invention presents an antenna device having a configuration in which a first radiation plate and a second radiation plate of which a diameter or one side is about ½ wavelength in electrical length are disposed on a ground plate at an arbitrary interval, a first power feed port and a second power feed port provided on the first radiation plate are disposed so that the straight lines linking each power feed port position and the middle point of the first radiation plate may be orthogonal to each other, a third power feed port and a fourth power feed port provided on the second radiation plate are disposed so that the straight lines linking each power feed port position and the middle point of the second radiation plate may be orthogonal to each other, and the two orthogonal straight lines of the first radiation plate are defined to have an angle of 45 degrees to the two orthogonal straight lines of the second radiation plate.

The invention also presents an antenna device having a configuration in which a first radiation plate and a second radiation plate of which a diameter or one side is about ½ wavelength in electrical length are disposed on a ground plate at an arbitrary interval, a first power feed port and a second power feed port provided on the first radiation plate are disposed so that the straight lines linking each power feed port position and the middle point of the first radiation plate may be orthogonal to each other, a third power feed port and a fourth power feed port are disposed also on the second radiation plate in a similar positional relation, and the straight line linking the middle point of the first power feed port and second power feed port and the middle point of the first radiation plate or the straight line orthogonal to this straight line at the middle point of the radiation plate and the straight line linking the middle point of the third power feed port and fourth power feed port and the middle point of the second radiation plate or the straight line orthogonal to this straight line at the middle point of the radiation plate are present on an identical straight line.

The invention further presents an antenna device having a configuration in which a first radiation plate and a second radiation plate of which a diameter or one side is about ½ wavelength in electrical length are disposed on a ground plate at an arbitrary interval, a first power feed port and a second power feed port are provided in the peripheral area of the first radiation plate, a first straight line linking the first power feed port provided on the first radiation plate and the middle point of the first radiation plate is orthogonal to a second straight line linking the second power feed port and the middle point of the first radiation plate, a third straight line linking a third power feed port provided on the second radiation plate and the middle point of the second radiation plate is orthogonal to a fourth straight line linking a fourth power feed port provided on the second radiation plate and the middle point of the second radiation plate, the electrical length of the first straight line and the electrical length of the third straight line and the electrical length of the second straight line and the electrical length of the fourth straight line are the identical length, the electrical length of the first straight line and the electrical length of the second straight line are different lengths, and the first straight line and the third straight line or the second straight line and the fourth straight line are present on different lines.

DESCRIPTION OF THE PREFERRED EMBODIMENTS

Figure 1A:
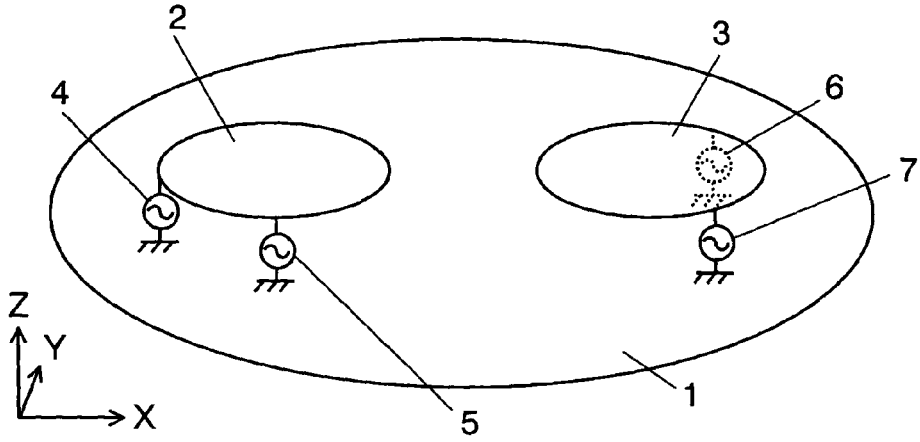
FIG. 1A is a perspective view of an antenna device in preferred embodiment 1.

Referring now to the drawings, preferred embodiments of the invention are described in detail below.

Preferred Embodiment 1

Figure 1B:
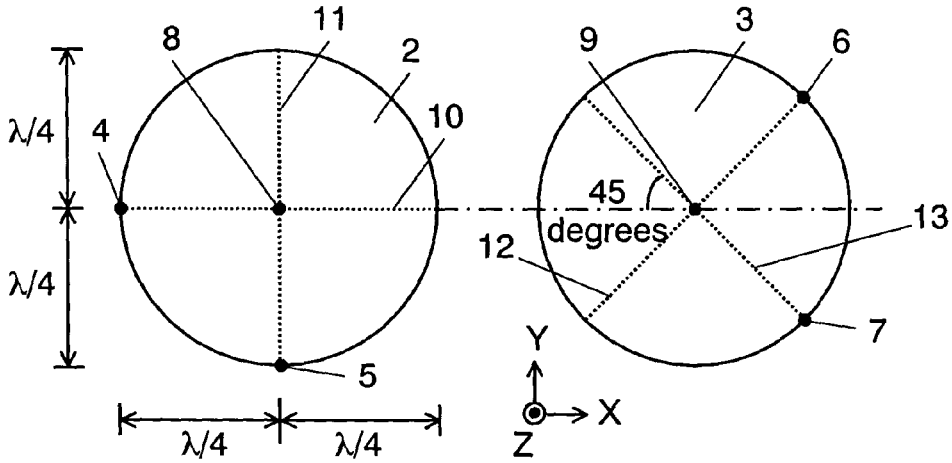
FIG. 1B is a top view of the antenna device of the same.

FIG. 1A and FIG. 1B show an antenna device in preferred embodiment 1, in which a first power feed port 4 and a second power feed port 5 are provided in a peripheral area of a circular first radiation plate 2 of which the diameter is about half wavelength in electrical length disposed oppositely to a ground plate 1, and a first straight line 10 linking the position of the first power feed port 4 and the middle point 8 of the first radiation plate 2 and a second straight line 11 linking the second power feed port 5 and the middle point 8 of the first radiation plate 2 cross each other at an angle of 90 degrees at the first middle point 8.

Similarly, as for a second radiation plate 3 disposed oppositely to the ground plate 1, closely to the first radiation plate 2, a third power feed port 6 and a fourth power feed port 7 are provided in its peripheral area in the same relation as in the case of the first radiation plate 2. The first radiation plate 2 and second radiation plate 3 are disposed so that a third straight line 12 and a fourth straight line 13 may cross each other at an angle of 45 degrees at the middle point 9 of the second radiation plate 3 when the first straight line 10 is extended.

Figure 1C:
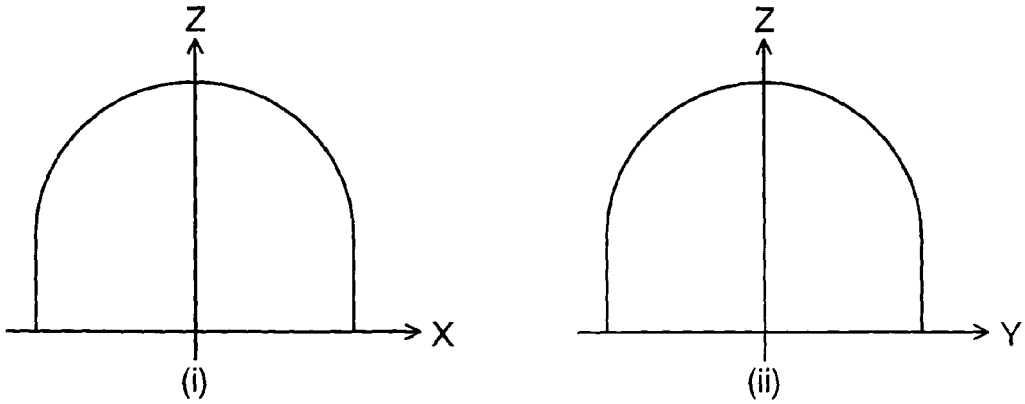
FIG. 1C is a radiation characteristic diagram of the antenna device of the same.

FIG. 1C shows an upward radiation pattern on the ground plate 1 when power is fed to the first radiation plate 2. Diagram (i) shows a radiation pattern of vertical polarized wave when power is supplied to the first power feed port 4 only. When power is supplied to the first power feed port 4, a vector of resonance current is generated in the direction of the first straight line 10, and an electric field of components parallel to this vector is radiated in a remote place. As a result, electromagnetic waves of vertical polarized wave are radiated only on the XZ plane, and electromagnetic waves of vertical polarized wave are not radiated on the YZ plane.

Therefore, when the second radiation plate 3 is disposed in the X-axis direction, if the maximum gain direction of the second radiation plate 3 is directed in the X-axis direction, the electromagnetic coupling of the first radiation plate 2 and second radiation plate 3 is increased, and favorable effect as diversity antenna cannot be obtained.

Diagram (ii) shows a radiation pattern of vertical polarized wave when power is supplied to the second power feed port 5 only, and according to the same principle as in (i), electromagnetic waves of vertical polarized wave are radiated only on the YZ plane, and electromagnetic waves of vertical polarized wave are not radiated on the XZ plane. Therefore, when the second radiation plate 3 is disposed in the Y-axis direction, it is required to design so that the maximum gain direction of the second radiation plate 3 may not be directed in the Y-axis direction.

Considering these requirements, in order to keep a proper isolation between the first power feed port 4 and second power feed port 5, the second radiation plate is disposed so that the third straight line 12 and fourth straight line 13 of the second radiation plate 3 may form an angle of 45 degrees at an intermediate angle of the X-axis and Y-axis. As a result, the correlation coefficient of power feed ports can be decreased, and an effective diversity antenna having four planes of polarization can be realized.

As an example of use of this antenna device, when the first power feed port 4 and second power feed port 5 of the first radiation plate 2 are used for Bluetooth, and the third power feed port 6 and fourth power feed port 7 of the second radiation plate 3 are used for W-LAN, a polarization diversity antenna module having polarization diversity antennas disposed closely corresponding to each system is realized, or when the first power feed port 4 and third power feed port 6 are used for Bluetooth, and the second power feed port 5 and fourth power feed port 7 are used for W-LAN, a diversity antenna combining the polarization diversity and space diversity corresponding to each system is realized.

As a result, directive diversity antennas of two systems are integrated and reduced in size. For example, it can be used as a diversity antenna for a terminal device capable of using Bluetooth and W-LAN simultaneously.

In FIGS. 1A, 1B, 1C, the space among the first radiation plate 2, second radiation plate 3 and ground plate 1 is filled with air, but it may be also composed of a dielectric material, a magnetic material, or a combination material thereof.

According to the invention, the isolation value among power feed ports can be designed at a high level, and hence the correlation coefficient can be suppressed low, and the diversity effect is enhanced, and moreover the first radiation plate and second radiation plate have two polarized waves orthogonal to each other respectively, and by disposing these antennas at a specific spacing, a composite diversity antenna of directive diversity and space diversity having planes of polarization at every 45 degrees is realized, and a favorable communication quality can be maintained even in fading environment.

The shape of the radiation plate is line symmetrical to the straight line linking each power feed port and the middle point of the radiation plate, and TM11 mode is generated between the radiation plate and ground plate, and therefore by disposing the power feed port at the orthogonal position on the radiation plate, isolation between power feed ports is assured, and an effective diversity antenna of low correlation coefficient is realized.

Preferred Embodiment 2

Figure 2A:
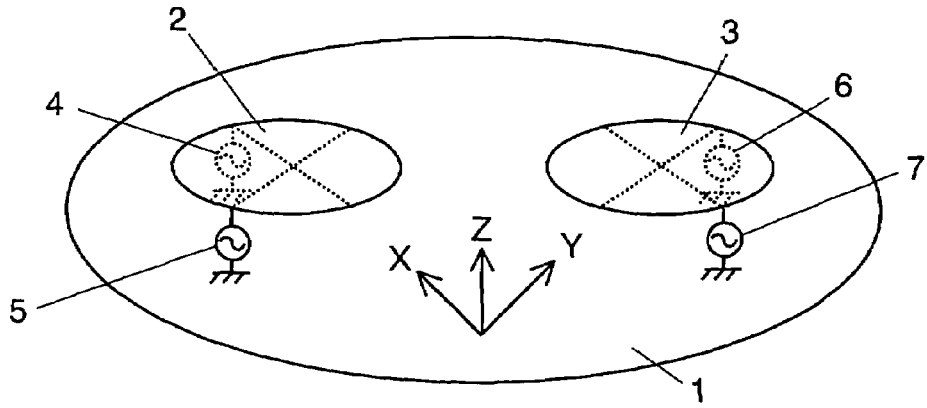
FIG. 2A is a perspective view of an antenna device in preferred embodiment 2.
Figure 2B:
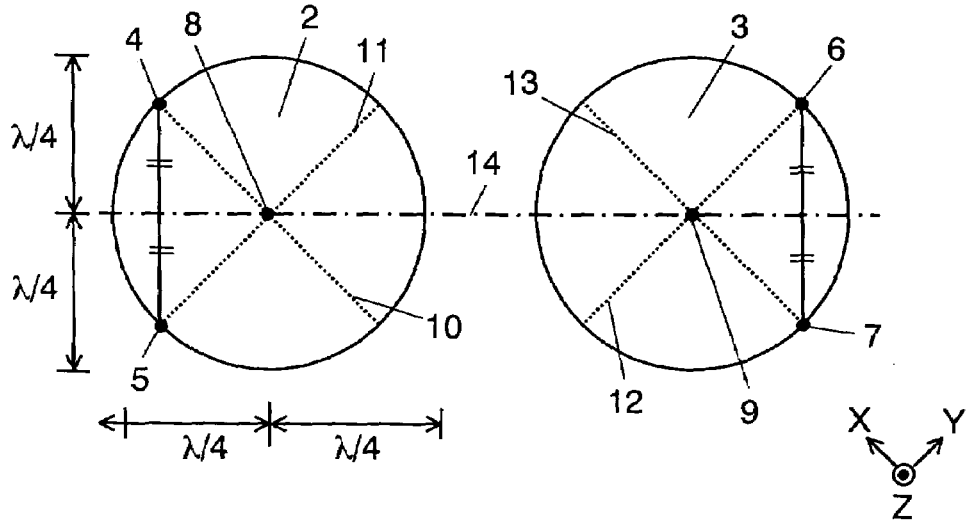
FIG. 2B is a top view of the antenna device in preferred embodiment 2.

FIG. 2A and FIG. 2B show an antenna device in preferred embodiment 2, in which a first power feed port 4 and a second power feed port 5 are provided in a peripheral area of a circular first radiation plate 2 of which the diameter is about half wavelength in electrical length disposed oppositely to a ground plate 1, and a straight line 10 linking the first power feed port 4 and the middle point 8 of the first radiation plate 2 and a second straight line 11 linking the second power feed port 5 and the middle point 8 of the first radiation plate 2 cross each other orthogonally at the middle point 8 of the first radiation plate 2. Similarly, as for a second radiation plate 3 disposed oppositely to the ground plate 1, closely to the first radiation plate 2, a third power feed port 6 and a fourth power feed port 7 are provided in its peripheral area in the same relation as in the case of the first radiation plate 2. The first radiation plate 2 and second radiation plate 3 are disposed so that a fifth straight line 14 linking the middle point of the first power feed port 4 and second power feed point 5 and the middle point 8 of the first radiation plate 2 and a straight line linking the middle point of the third power feed port 6 and fourth power feed point 7 and the middle point 9 of the second radiation plate 3 may coincide with each other.

Figure 2C:
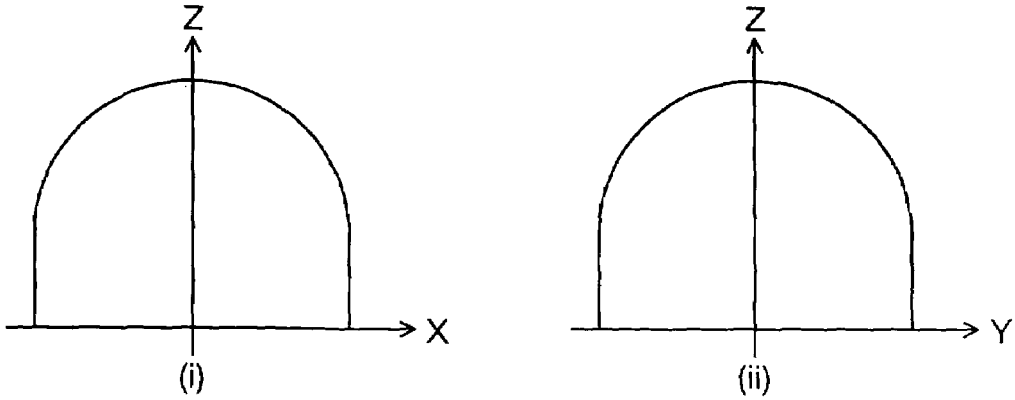
FIG. 2C is a radiation characteristic diagram of the antenna device in preferred embodiment 2.

FIG. 2C shows an upward radiation pattern on the ground plate 1 when power is fed to the first radiation plate 2. Diagram (i) shows a radiation pattern of vertical polarized wave when power is supplied to the first power feed port 4 only. When power is supplied to the first power feed port 4, a vector of resonance current is generated in the direction of the first straight line 10, and an electric field of components parallel to this vector is radiated in a remote place. As a result, electromagnetic waves of vertical polarized wave are radiated only on the XZ plane, and electromagnetic waves of vertical polarized wave are not radiated on the YZ plane. Therefore, when the second radiation plate 3 is disposed in the X-axis direction, if the maximum gain direction of the second radiation plate 3 is directed in the X-axis direction, the electromagnetic coupling of the first radiation plate 2 and second radiation plate 3 is increased, and favorable effect as diversity antenna cannot be obtained.

Diagram (ii) shows a radiation pattern of vertical polarized wave when power is supplied to the second power feed port 5 only, and according to the same principle as in (i), electromagnetic waves of vertical polarized wave are radiated only on the YZ plane, and electromagnetic waves of vertical polarized wave are not radiated on the XZ plane. Therefore, in order that the maximum gain direction when power is supplied to each power feed port of the first radiation plate 2 and the maximum gain direction when power is supplied to each power feed port of the second radiation plate 3 may not coincide oppositely, the first straight line 10, second straight line 11, third straight line 12, and fourth straight line 13 are disposed so as not to be present on an identical line. As a result, the correlation coefficient of power feed ports can be decreased, and an effective diversity antenna having four planes of polarization can be realized.

According to the invention, while maintaining a high isolation value among the power feed ports, the number of branches of antenna can be increased, and even in environments of multiple occurrences of deep attenuation of reception power due to multipath fading, a diversity antenna capable of maintaining a high communication quality can be realized.

Besides, since TM11 mode is generated between the radiation plate and ground plate, by disposing power feed ports at orthogonal positions on the radiation plate, isolation among power feed ports can be assured, and an effective diversity antenna of low correlation coefficient can be realized.

As an example of use of this antenna device, when the first power feed port 4 and second power feed port 5 of the first radiation plate 2 are used for Bluetooth, and the third power feed port 6 and fourth power feed port 7 of the second radiation plate 3 are used for W-LAN, a polarization diversity antenna module having polarization diversity antennas disposed closely corresponding to each system is realized, or when the first power feed port 4 and third power feed port 6 are used for Bluetooth, and the second power feed port 5 and fourth power feed port 7 are used for W-LAN, a diversity antenna combining the polarization diversity and space diversity corresponding to each system is realized.

In FIGS. 2A, 2B, 2C, the space among the first radiation plate 2, second radiation plate 3 and ground plate 1 is filled with air, but it may be also composed of a dielectric material, a magnetic material, or a combination material thereof.

Preferred Embodiment 3

Figure 3A:
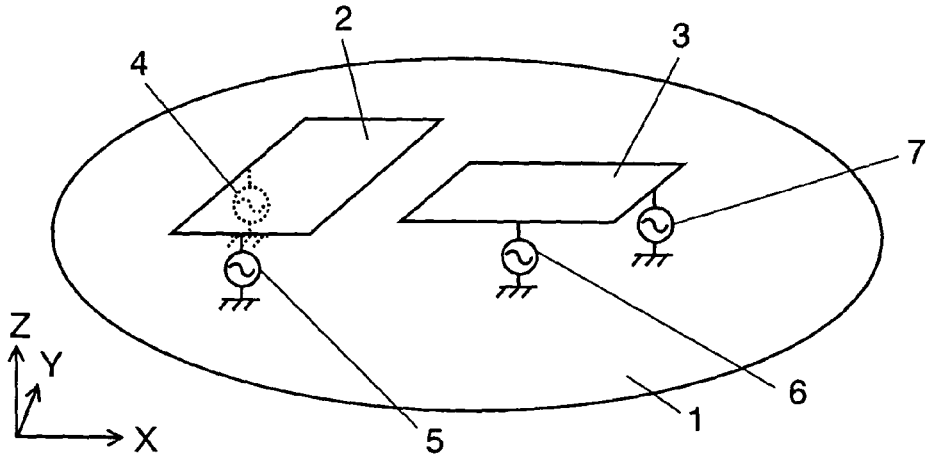
FIG. 3A is a perspective view of an antenna device in preferred embodiment 3.
Figure 3B:
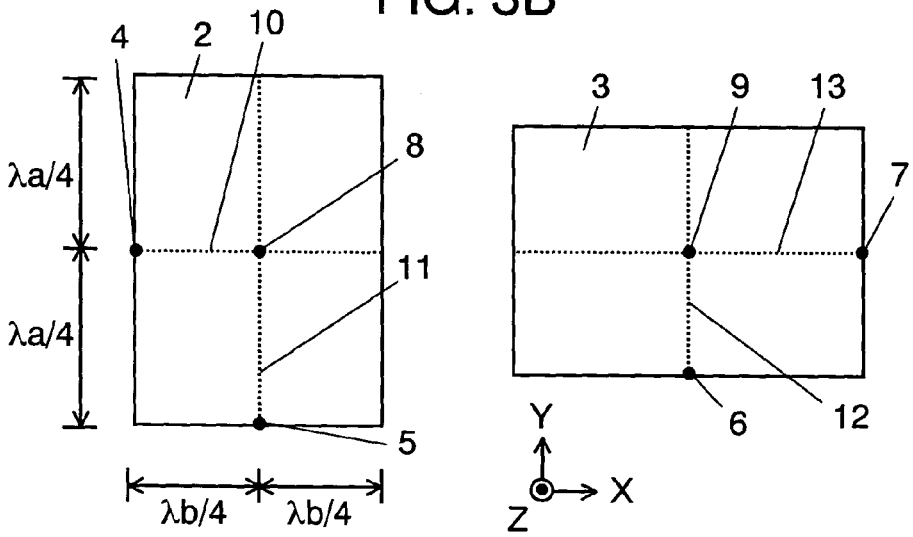
FIG. 3B is a top view of the antenna device in preferred embodiment 3.

FIG. 3A and FIG. 3B show an antenna device in preferred embodiment 3, in which a first power feed port 4 and a second power feed port 5 are provided in a peripheral area of a rectangular first radiation plate 2 of which one side is about half wavelength in electrical length disposed oppositely to a ground plate 1, and a first straight line 10 linking the position of the first power feed port 4 and a first middle point 8 and a second straight line 11 linking the second power feed port 5 and the first middle point 8 cross each other at an angle of 90 degrees at the first middle point 8. Similarly, as for a second radiation plate 3 disposed oppositely to the ground plate 1, closely to the first radiation plate 2, a third power feed port 6 and a fourth power feed port 7 are provided in its peripheral area in the same relation as in the case of the first radiation plate 2. The first radiation plate 2 and second radiation plate 3 are disposed so that the first straight line 10, when extended, may cross with a third straight line 12 at an angle of 90 degrees, and may not exist on a same straight line.

Figure 3C:
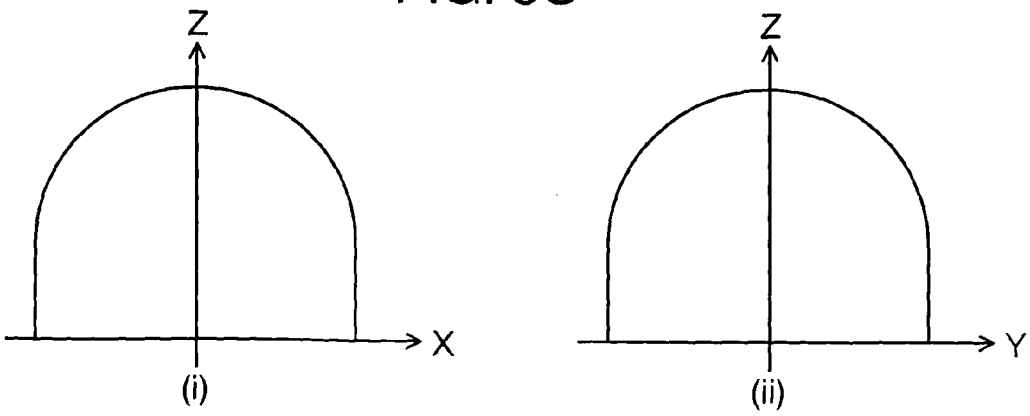
FIG. 3C is a radiation characteristic diagram of the antenna device in preferred embodiment 3.

FIG. 3C shows an upward radiation pattern on the ground plate 1 when power is fed to the first radiation plate 2. Diagram (i) shows a radiation pattern of vertical polarized wave when power is supplied to the first power feed port 4 only. When power is supplied to the first power feed port 4, a vector of resonance current is generated in the direction of the first straight line 10, and an electric field of components parallel to this vector is radiated in a remote place. As a result, electromagnetic waves of vertical polarized wave are radiated only on the XZ plane, and electromagnetic waves of vertical polarized wave are not radiated on the YZ plane. Therefore, when the second radiation plate 3 of same resonance frequency is disposed in the X-axis direction, if the maximum gain direction of the second radiation plate 3 is directed in the X-axis direction, the electromagnetic coupling of the first radiation plate 2 and second radiation plate 3 is increased, and favorable effect as diversity antenna cannot be obtained.

Diagram (ii) shows a radiation pattern of vertical polarized wave when power is supplied to the second power feed port 5 only, and according to the same principle as in (i), electromagnetic waves of vertical polarized wave are radiated only on the YZ plane, and electromagnetic waves of vertical polarized wave are not radiated on the XZ plane. Therefore, when disposing the second radiation plate 3 in the Y-axis direction, it must be designed so that the maximum gain direction of the second radiation plate 3 having the same resonance frequency may not be directed in the Y-axis direction.

Considering these requirements, by defining the maximum gain directions orthogonal when power is supplied to the first power feed port 4 and third power feed port 6 having the same resonance frequency, and assuring isolation between the both power feed ports, the correlation coefficient between the power feed ports can be decreased, and an effective diversity antenna can be realized.

Further, since one antenna has two power feed ports of different resonance frequencies of assured isolation, the number of necessary antennas can be reduced generally to a half, and the cost and space of installation can be saved.

As an example of use of this antenna device, when the first power feed port 4 of the first radiation plate 2 and the third power feed port 6 of the second radiation plate 3 are used for GSM system, and the second power feed port 5 of the first radiation plate 2 and the fourth power feed port 7 of the second radiation plate 3 are used for DCS system, a diversity antenna combining the polarization diversity and space diversity corresponding to the two systems is realized, or when the first power feed port 4 and second power feed port 5 are used for GSM transmission system, and the third power feed port 6 and fourth power feed port 7 are used for GSM reception system, a diversity antenna combining the polarization diversity and space diversity corresponding to one system is realized.

In FIGS. 3A, 3B, 3C, the space among the first radiation plate 2, second radiation plate 3 and ground plate 1 is filled with air, but it may be also composed of a dielectric material, a magnetic material, or a combination material thereof.

Preferred Embodiment 4

Figure 4A:
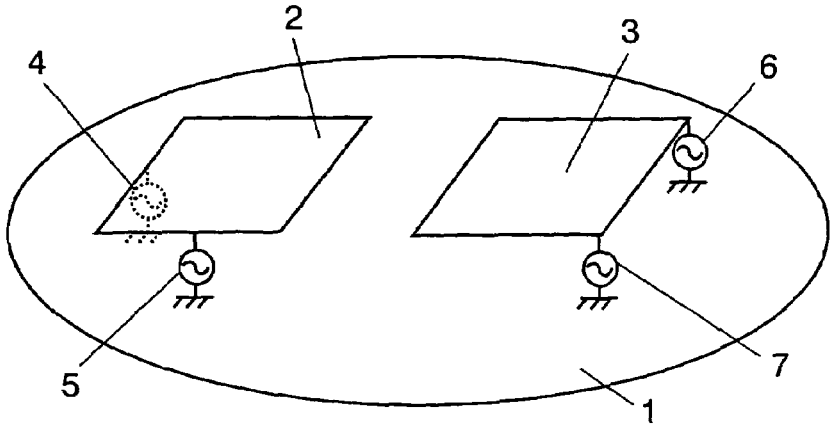
FIG. 4A is a perspective view of an antenna device in preferred embodiment 4.
Figure 4B:
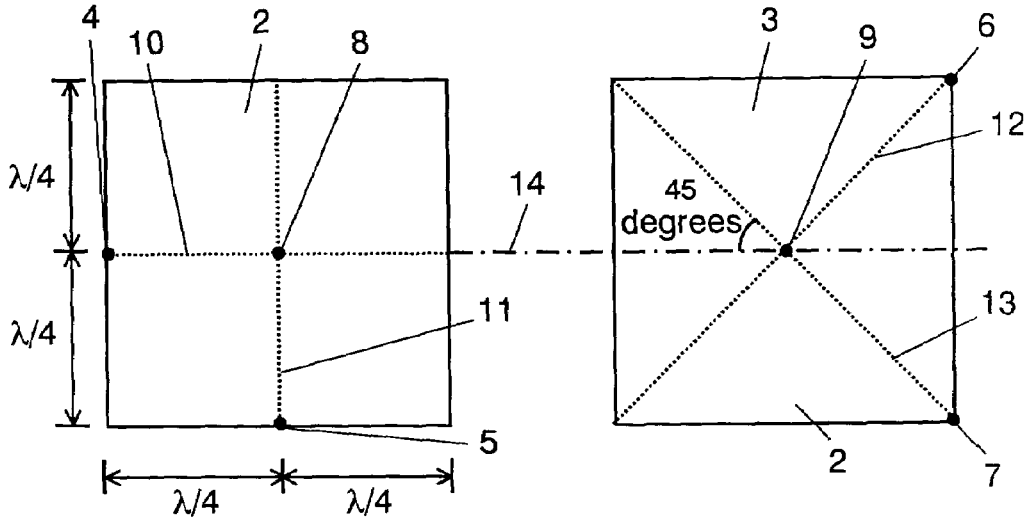
FIG. 4B is a top view of the antenna device of the same.

FIG. 4A and FIG. 4B show an antenna device in preferred embodiment 4, and preferred embodiment 4 is similar to preferred embodiment 1, except that the shape of the radiation plate is changed from circular shape to square shape. Whether in circular shape or in square shape, the shape is symmetrical to the straight lines linking the power feed ports and the middle point of radiation plate, and both have similar characteristics. Moreover, if the size of the radiation plate is reduced by forming slits in the peripheral area of the radiation plate so as to be symmetrical to the straight lines linking the power feed ports and the middle point of radiation plate, same effects as the antenna device in preferred embodiment 1 are obtained.

Preferred Embodiment 5

Figure 5A:
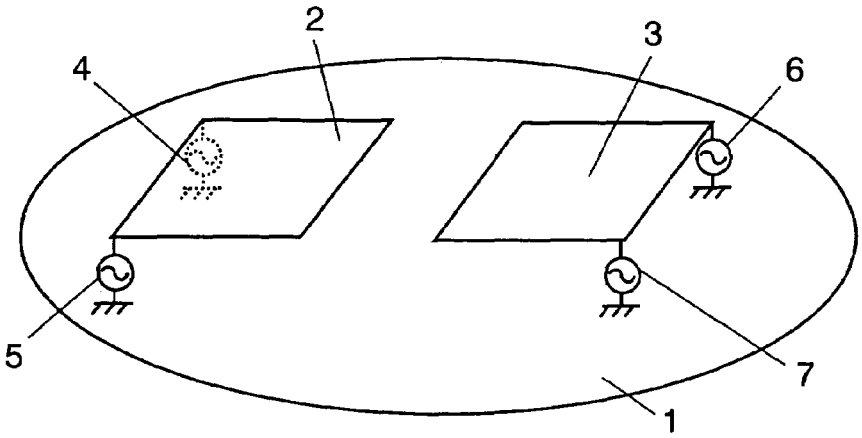
FIG. 5A is a perspective view of an antenna device in preferred embodiment 5.
Figure 5B:
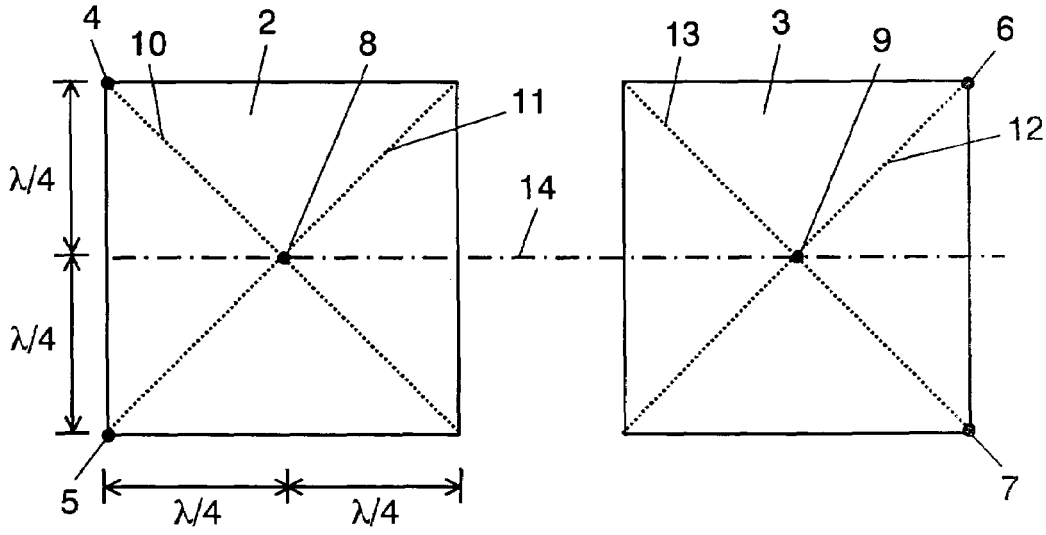
FIG. 5B is a top view of the antenna device in preferred embodiment 5.

FIG. 5A and FIG. 5B show an antenna device in preferred embodiment 5, and preferred embodiment 5 is similar to preferred embodiment 2, except that the shape of the radiation plates 2, 3 is changed from circular shape to square shape.

Same effects as in preferred embodiment 4 are obtained.

Preferred Embodiment 6

Figure 27:
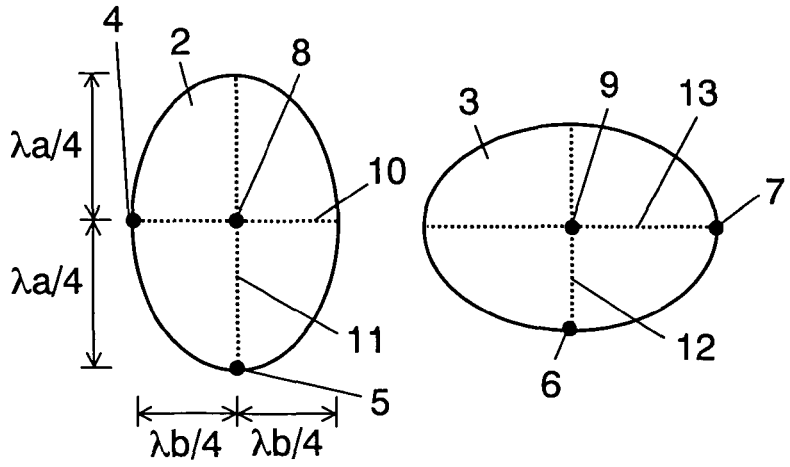
FIG. 27 is a top view of an antenna device in preferred embodiment 6.

FIG. 27 shows an antenna device in preferred embodiment 6, in which the shape of the radiation plates 2, 3 in preferred embodiment 3 is changed from rectangular shape to elliptical shape.

Same effects as in preferred embodiment 4 are obtained.

Preferred Embodiment 7

Figure 28:
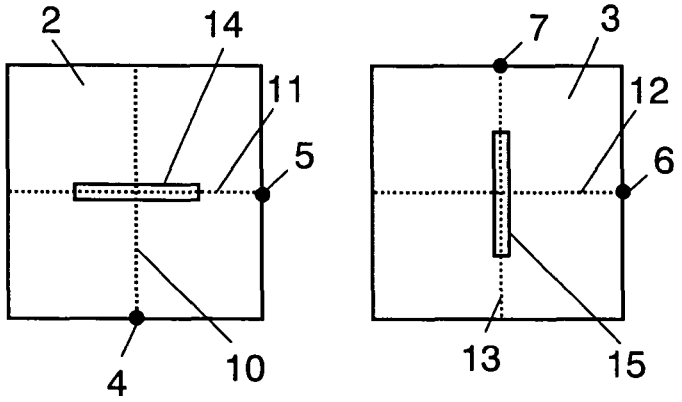
FIG. 28 is a top view of an antenna device in preferred embodiment 7.

FIG. 28 shows an antenna device in preferred embodiment 7, in which a first slit 14 is provided in the middle of a nearly square first radiation plate 2, and a second slit 15 is provided in the middle of a second radiation plate 3, and therefore a first straight line 10 in a flowing direction of resonance current when power is supplied to a first power feed port 4 is disturbed by the first slit 14, and the resonance current flows while turning around the side of the first slit 14, so that the resonance frequency of the first power feed port 4 is lower than the resonance frequency of the second power feed port 5. As a result, although the shape of the radiation plates 2, 3 is square shape, same effects as in preferred embodiment 3 are obtained.

Preferred Embodiment 8

Figure 29:
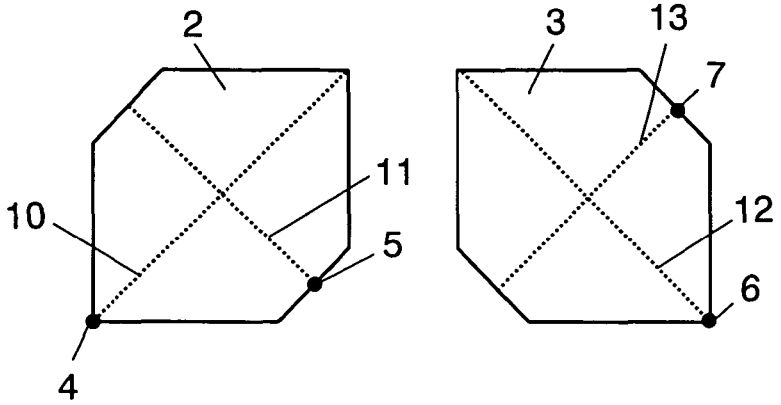
FIG. 29 is a top view of an antenna device in preferred embodiment 8.
Figure 30A:
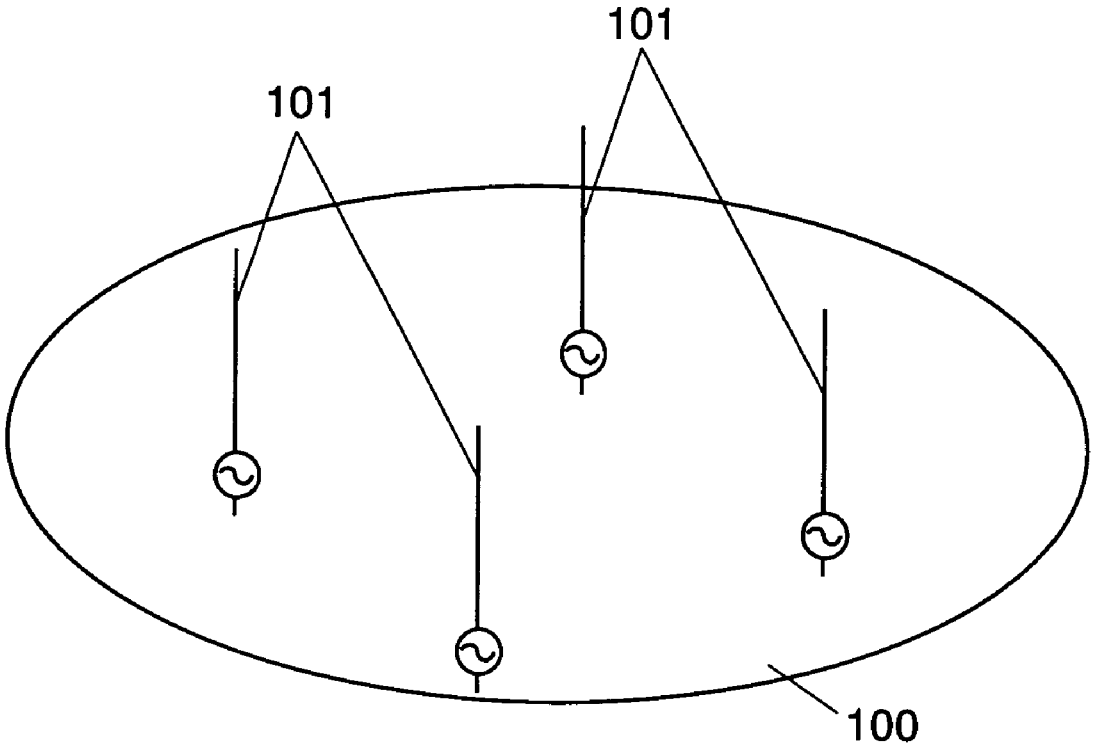
FIG. 30A PRIOR ART
FIG. 30A is a perspective view of an antenna device in a first prior art.
Figure 30B:
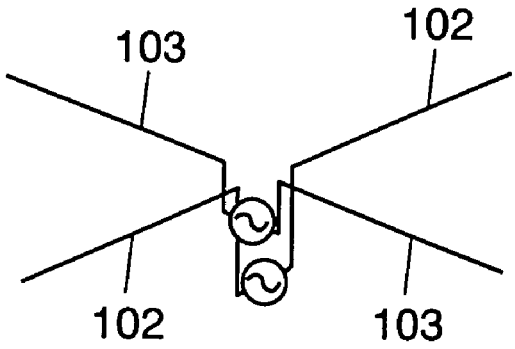
FIG. 30B PRIOR ART
FIG. 30B is a perspective view of an antenna device in a second prior art.

FIG. 29 shows an antenna device in preferred embodiment 8, in which two corners of radiation plates symmetrical to the middle point of the nearly square first and second radiation plates 2, 3 are cut off, and hence the electrical length is different between a first straight line 10 and a second straight line 11, and between a third straight line 12 and a fourth straight line 13, so that same effects as in preferred embodiment 3 are obtained.

Preferred Embodiment 9

Figure 6A:
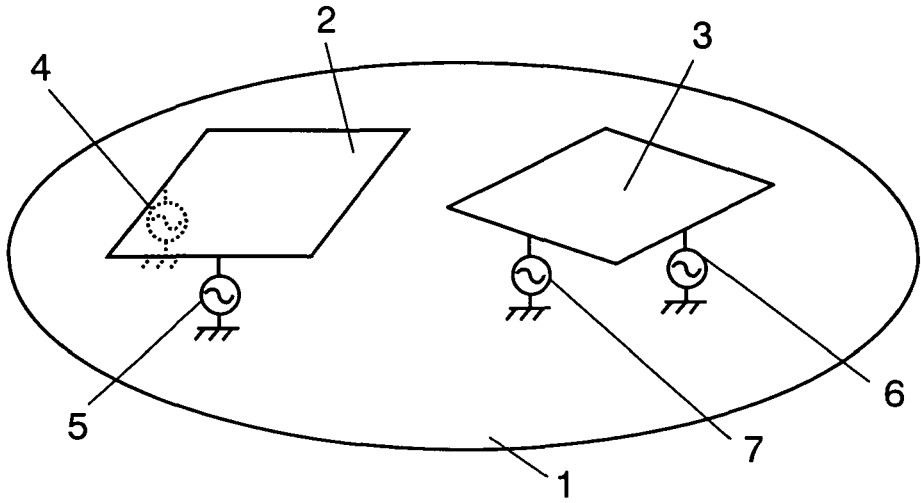
FIG. 6A is a perspective view of an antenna device in preferred embodiment 9.
Figure 6B:
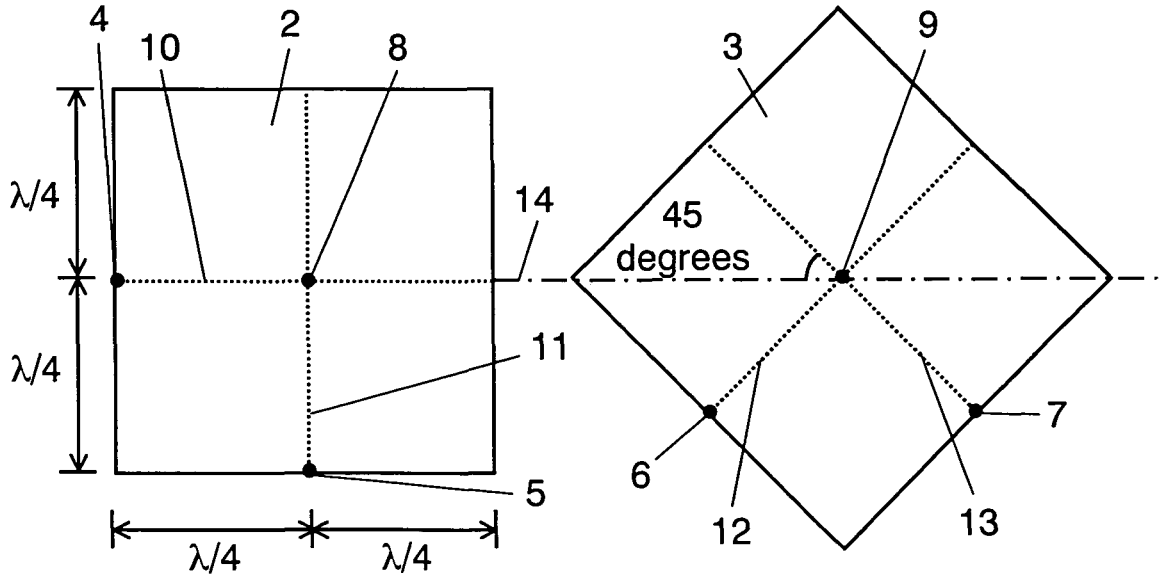
FIG. 6B is a top view of the antenna device of the same.

FIG. 6A and FIG. 6B show an antenna device in preferred embodiment 9, and preferred embodiment 9 is similar to preferred embodiment 4, except that the positions of power feed ports 6, 7 of the second radiation plate 3 are changed from corners of the square to the middle of the end sides. To match the configuration of a first straight line 10, a second straight line 11, a third straight line 12, and a fourth straight line 13 with that of preferred embodiment 4, the second radiation plate 3 is disposed by rotating 45 degrees to the first radiation plate 2.

Preferred Embodiment 10

Figure 7A:
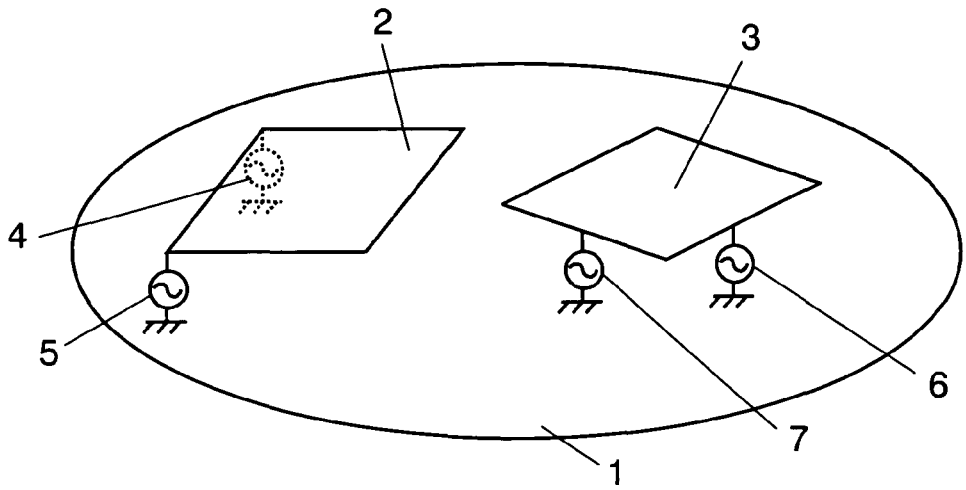
FIG. 7A is a perspective view of an antenna device in preferred embodiment 10.
Figure 7B:
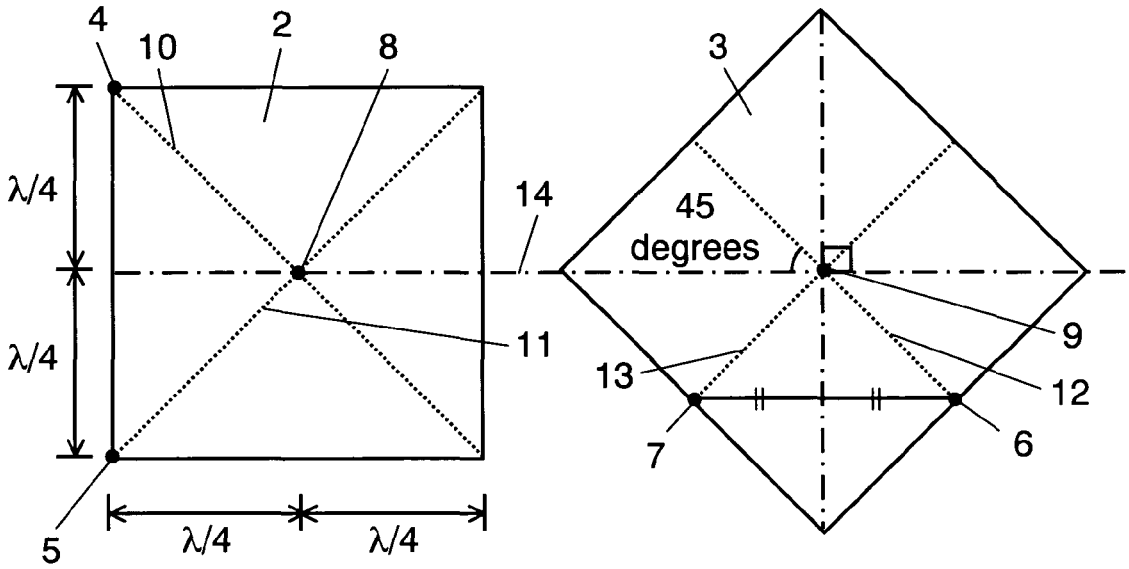
FIG. 7B is a top view of the antenna device in preferred embodiment 10.

FIG. 7A and FIG. 7B show an antenna device in preferred embodiment 10, and preferred embodiment 10 is similar to preferred embodiment 5, except that the positions of power feed ports 6, 7 of the second radiation plate 3 are changed from corners of the square to the middle of the end sides. To match the configuration of a first straight line 10, a second straight line 11, a third straight line 12, and a fourth straight line 13 with that of preferred embodiment 5, the second radiation plate 3 is disposed by rotating 45 degrees to the first radiation plate 2.

Preferred Embodiment 11

Figure 8A:
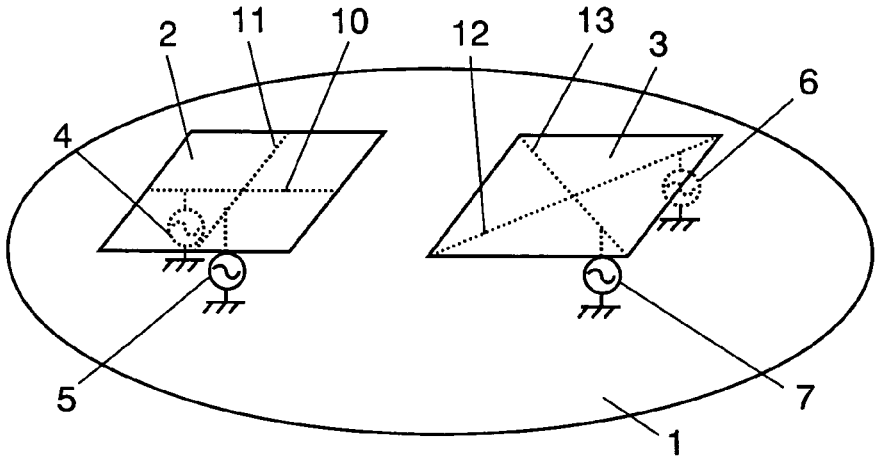
FIG. 8A is a perspective view of an antenna device in preferred embodiment 11.
Figure 8B:
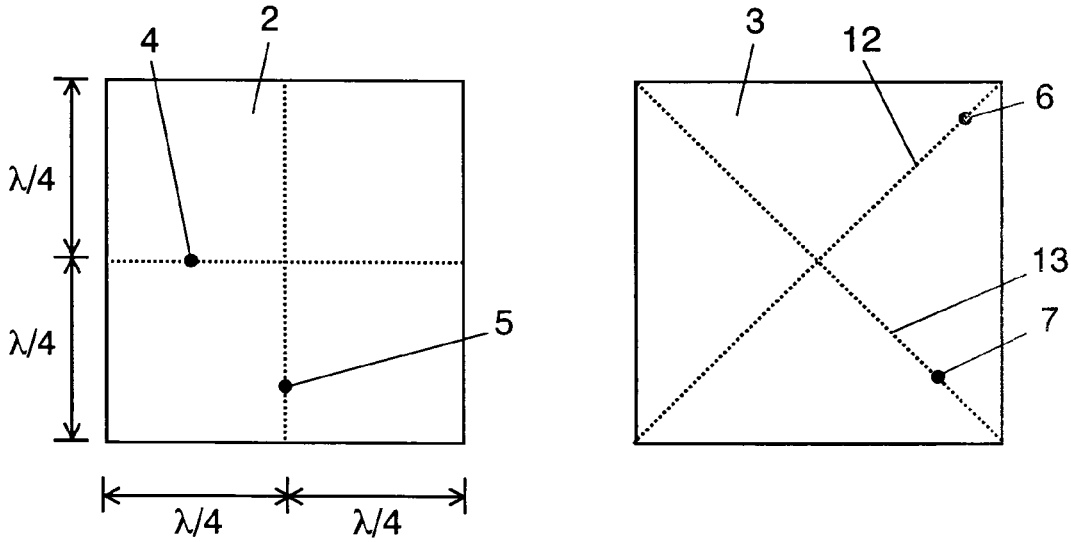
FIG. 8B is a top view of the antenna device of the same.

FIG. 8A and FIG. 8B show an antenna device in preferred embodiment 11, and preferred embodiment 11 is similar to preferred embodiment 9, except that the positions of power feed ports are changed from end portions of the radiation plates 2, 3 to positions on a straight line linking the power feed ports other than the end portions of the radiation plates 2, 3 and the middle point of the radiation plate. By finding the power feed position matched on the straight line linking the power feed ports other than the end portions of the radiation plates 2, 3 and the middle point of the radiation plate, power can be supplied without requiring a matching circuit, and the matching elements are curtailed and the space for mounting matching elements can be saved.

Preferred Embodiment 12

Figure 9A:
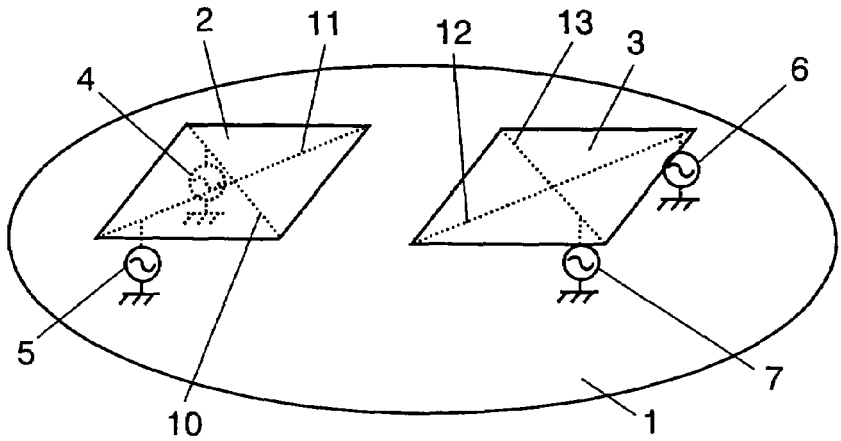
FIG. 9A is a perspective view of an antenna device in preferred embodiment 12.
Figure 9B:
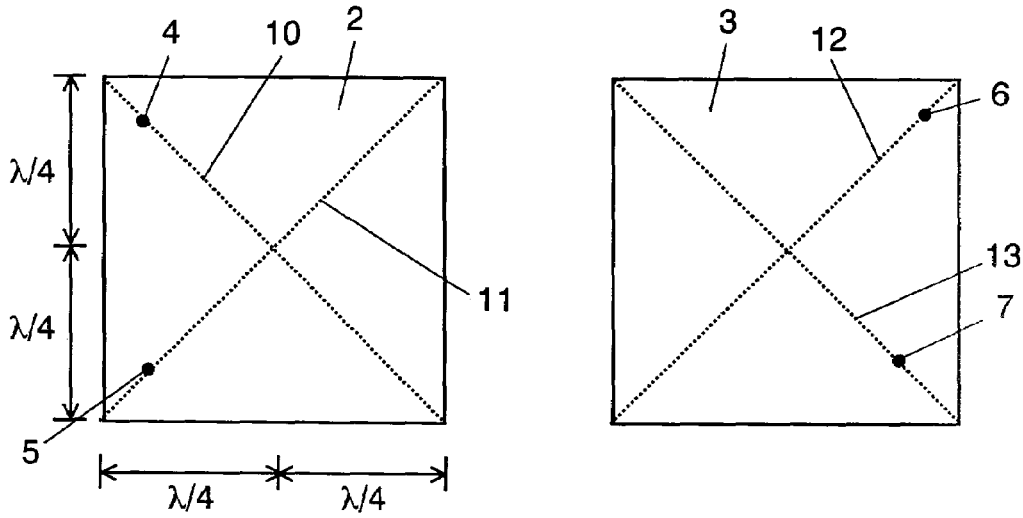
FIG. 9B is a top view of the antenna device in preferred embodiment 12.

FIG. 9A and FIG. 9B show an antenna device in preferred embodiment 12, and preferred embodiment 12 is similar to preferred embodiment 10, except that the positions of power feed ports 4 to 7 are changed from end portions of radiation plates 2, 3 to positions on a straight line linking the power feed ports other than the end portions of the radiation plates 2, 3 and the middle point of the radiation plates 2, 3.

Same effects as in preferred embodiment 11 are obtained.

Preferred Embodiment 13

Figure 10:
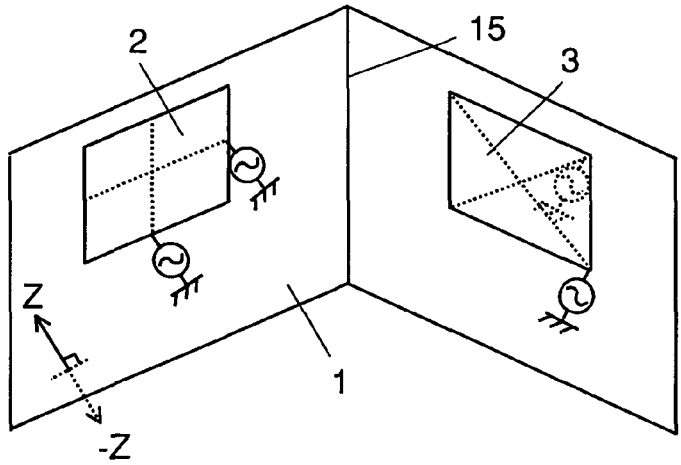
FIG. 10 is a perspective view of an antenna device in preferred embodiment 13.

FIG. 10 shows an antenna device in preferred embodiment 13, and preferred embodiment 13 has a structure in which the ground plate 1 is bent by a ground flexure 15 between a first radiation plate 2 and a second radiation plate 3. Since the radiation gain of the first radiation plate 2 in the −Z direction is small, according to preferred embodiment 13 in which the second radiation plate 3 is disposed in the −Z direction on a horizontal plane of the ground plate 1 opposite to the first radiation plate 2, the isolation between the ports can be further increased, and the effects of the diversity antenna can be enhanced. In preferred embodiment 13, the radiation plates are formed in square shape, but same effects are obtained in radiation plates in circular shape.

Preferred Embodiment 14

Figure 11:
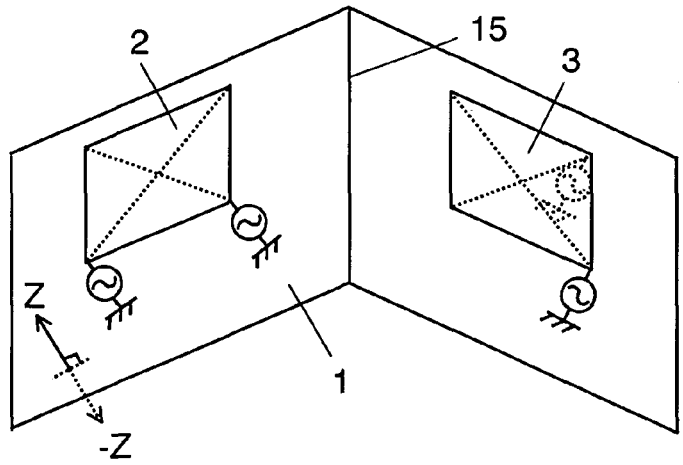
FIG. 11 is a perspective view of an antenna device in preferred embodiment 14.

FIG. 11 shows an antenna device in preferred embodiment 14, and preferred embodiment 14 has a structure in which the ground plate 1 is bent by a ground flexure 15 between a first radiation plate 2 and a second radiation plate 3.

Same effects as in preferred embodiment 14 are obtained.

Preferred Embodiment 15

Figure 13A:
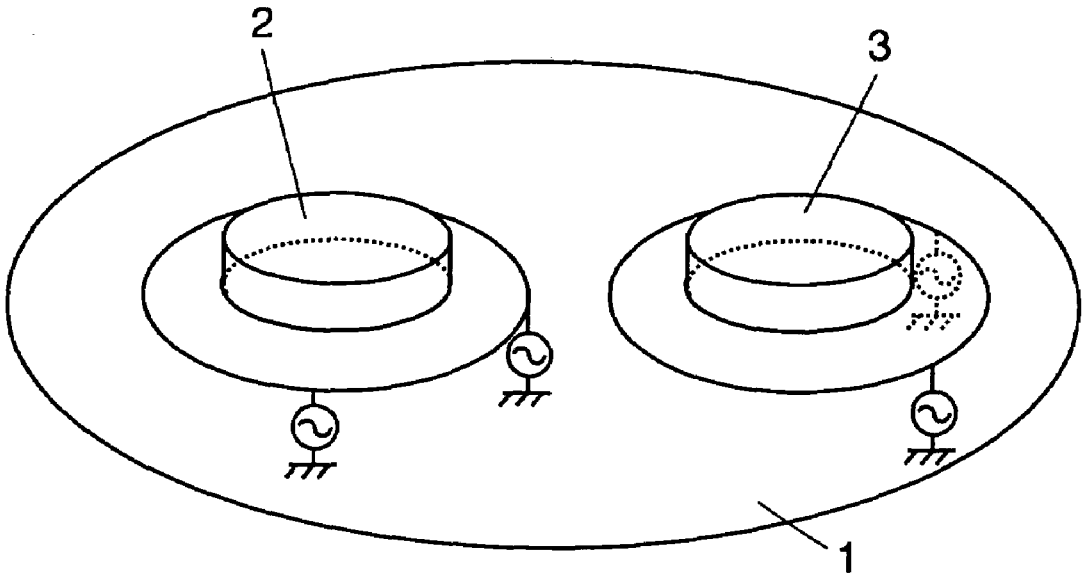
FIG. 13A is a perspective view of an antenna device in preferred embodiment 15.
Figure 13B:
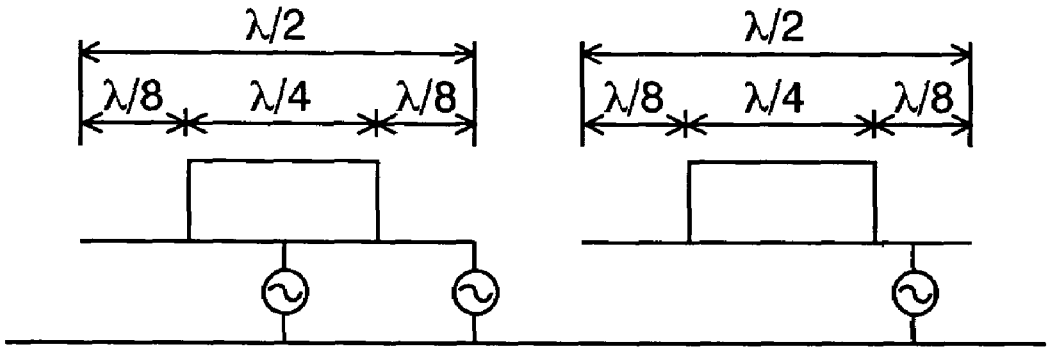
FIG. 13B is a top view of the antenna device of the same.

FIG. 13A and FIG. 13B show an antenna device in preferred embodiment 15, and in FIGS. 13A, 13B, the shape of first radiation plate 2 and second radiation plate 3 is convex shape so that the interval (distance) from the ground plate 1 to the radiation plates 2, 3 in a region of about ⅛ wavelength in electrical length from the end portion of the radiation plate may be narrower than the interval (distance) from the ground plate 1 to the first radiation plate 2 and second radiation plate 3 in other regions on the radiation plate. In such structure, the size of the radiation plate can be reduced according to the principle of the resonator having a SIR structure (stepped impedance resonator), and a space diversity antenna can be realized while saving the space. In preferred embodiment 15, the radiation plates 2, 3 are formed in convex shape, but same effects are obtained by forming the ground plate 1 in concave shape.

Preferred Embodiment 16

Figure 14A:
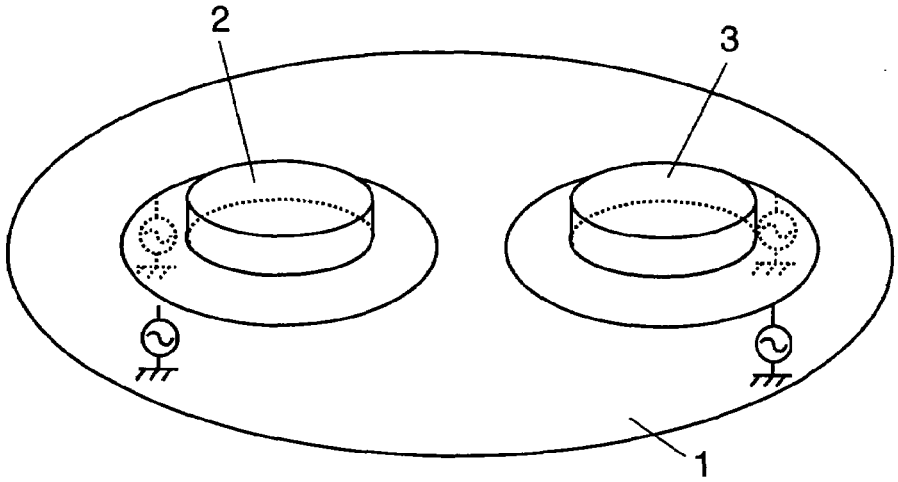
FIG. 14A is a perspective view of an antenna device in preferred embodiment 16.
Figure 14B:
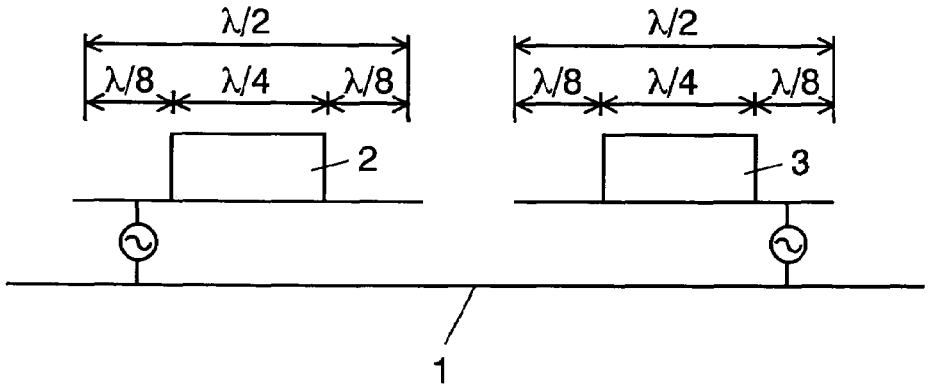
FIG. 14B is a top view of the antenna device in preferred embodiment 16.

FIG. 14A and FIG. 14B show an antenna device in preferred embodiment 16, and in FIGS. 14A, 14B, the shape of first radiation plate 2 and second radiation plate 3 is convex shape so that the interval from the ground plate 1 to the radiation plates in a region of about ⅛ wavelength in electrical length from the end portion of the radiation plate may be narrower than the interval from the ground plate 1 to the first radiation plates in another region on the radiation plate.

Same effects as in preferred embodiment 15 are obtained.

Preferred Embodiment 17

Figure 15A:
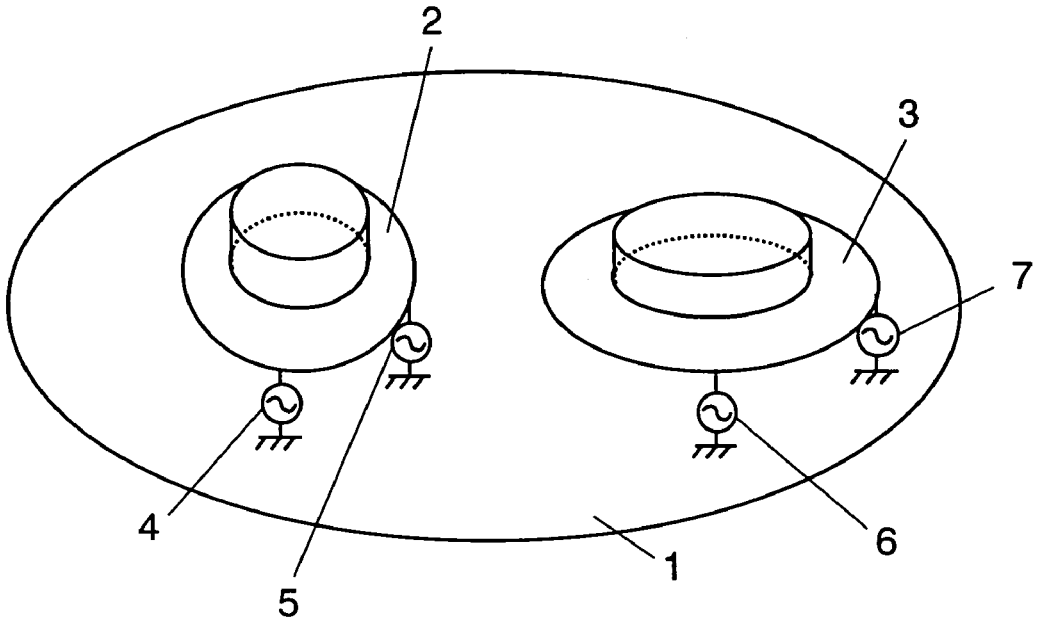
FIG. 15A is a perspective view of an antenna device in preferred embodiment 17.
Figure 15B:
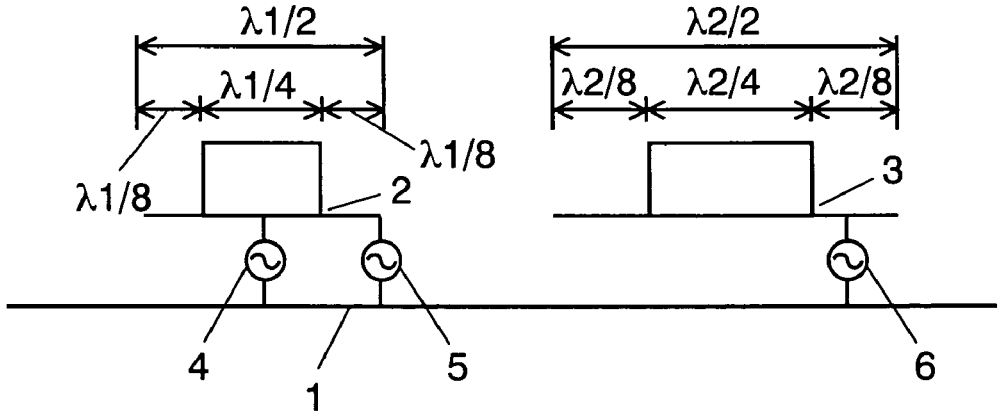
FIG. 15B is a sectional view of the antenna device in preferred embodiment 17.

FIG. 15A and FIG. 15B show an antenna device in preferred embodiment 17, and in FIGS. 15A, 15B, the shape of first radiation plate 2 and second radiation plate 3 is convex shape so that the interval from the ground plate 1 to the radiation plates 2, 3 in a region of about ⅛ wavelength in electrical length from the end portion of the radiation plate may be narrower than the interval from the ground plate 1 to the first radiation plate 2 and second radiation plate 3 in another region on the radiation plate, on a straight line linking the position of each power feed port and the middle point of the radiation plate. In such structure, the size of the radiation plates 2, 3 can be reduced according to the principle of the resonator of SIR structure, and a space diversity antenna can be realized while saving the space.

In preferred embodiment 17, the radiation plates 2, 3 are formed in convex shape, but same effects are obtained by forming the ground plate 1 in concave shape. In FIGS. 15A, 15B, the space among the first radiation plate 2, second radiation plate 3 and ground plate 1 is filled with air, but it may be also composed of a dielectric material, a magnetic material, or a combination material thereof.

Preferred Embodiment 18

Figure 16A:
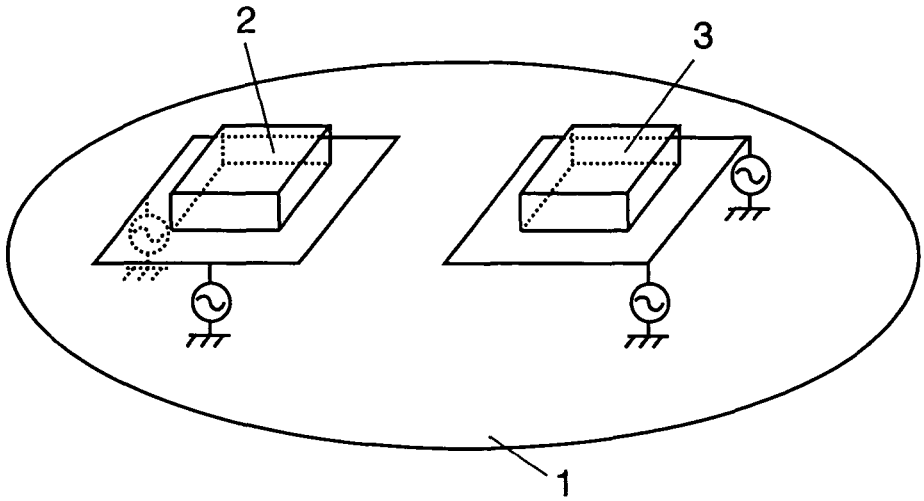
FIG. 16A is a perspective view of an antenna device in preferred embodiment 18.
Figure 16B:
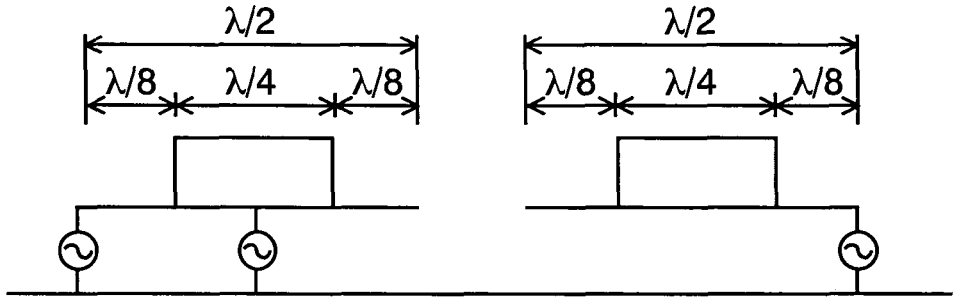
FIG. 16B is a top view of the antenna device of the same.

FIG. 16A and FIG. 16B show an antenna device in preferred embodiment 18, and preferred embodiment 18 is similar to preferred embodiment 15, except that the shape of radiation plates 2, 3 is changed from circular shape to square shape. Both circular shape and square shape are symmetrical to the straight lines linking the power feed ports and the middle point of the radiation plates 2, 3, and both have similar characteristics.

Preferred Embodiment 19

Figure 17A:
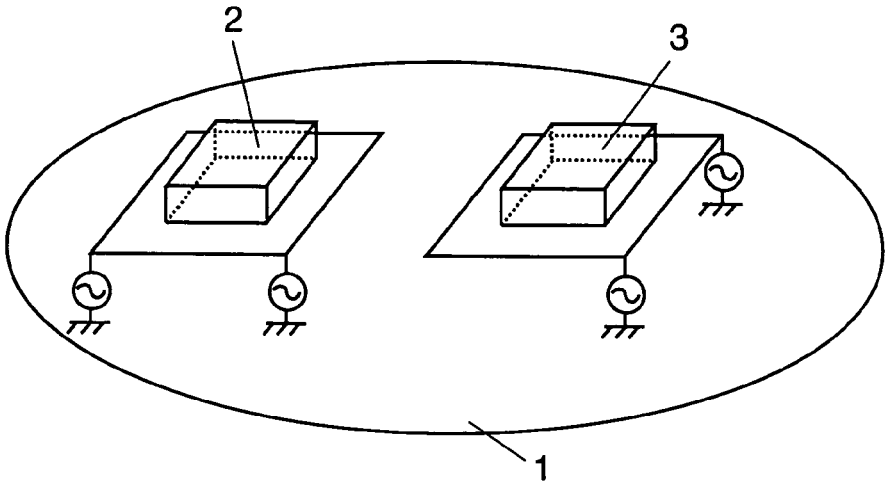
FIG. 17A is a perspective view of an antenna device in preferred embodiment 19.
Figure 17B:
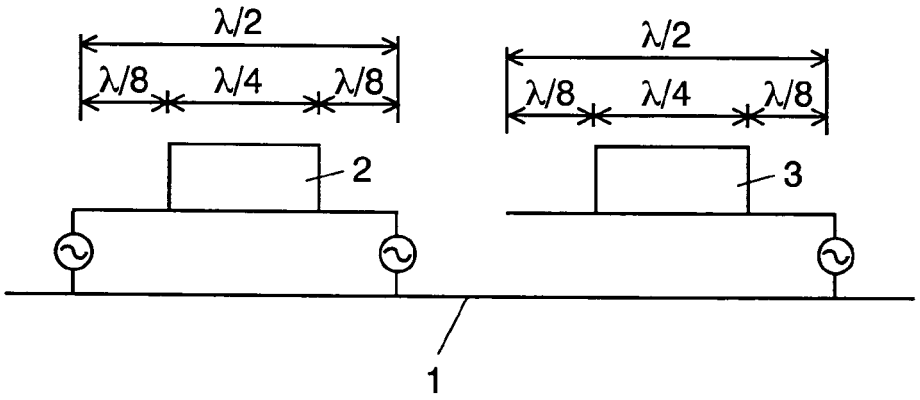
FIG. 17B is a top view of the antenna device in preferred embodiment 19.

FIG. 17A and FIG. 17B show an antenna device in preferred embodiment 19, and preferred embodiment 19 is similar to preferred embodiment 16, except that the shape of radiation plates 2, 3 is changed from circular shape to square shape. Both circular shape and square shape are symmetrical to the straight lines linking the power feed ports and the middle point of the radiation plates, and both have similar characteristics.

Preferred Embodiment 20

Figure 18A:
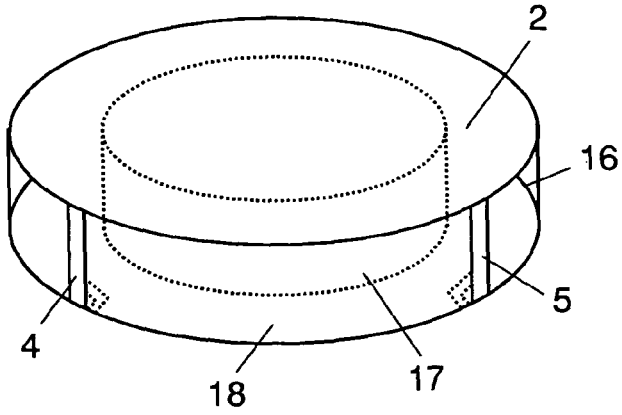
FIG. 18A is a magnified view of an antenna device in preferred embodiment 20.
Figure 18B:
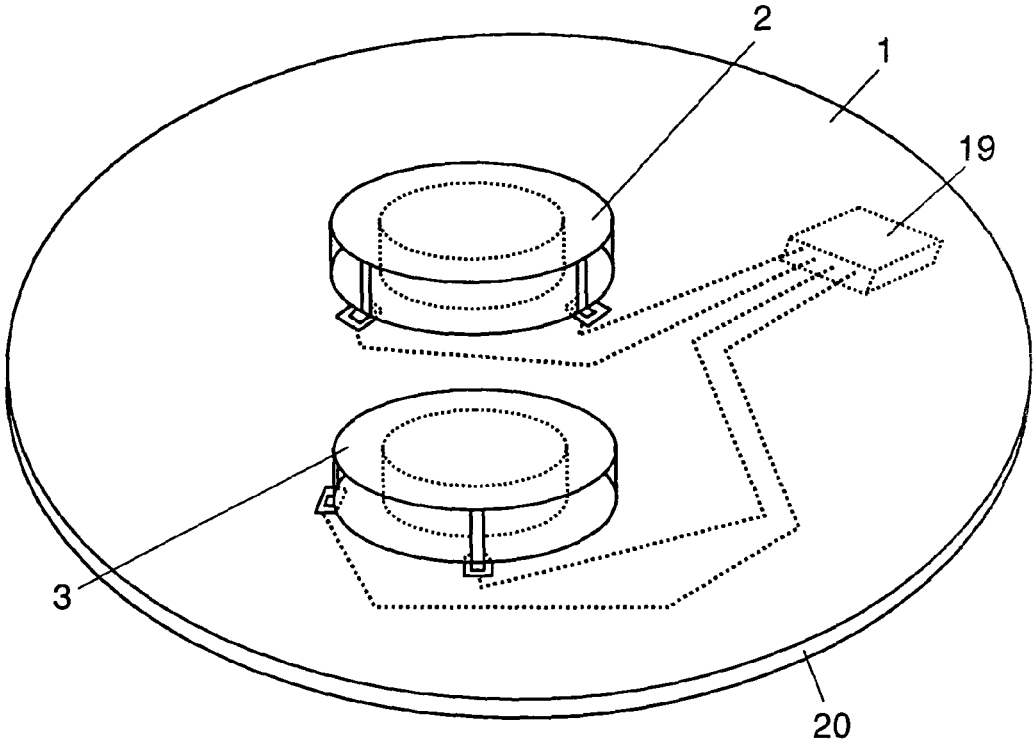
FIG. 18B is a perspective view of the antenna device of the same.

FIG. 18A and FIG. 18B show an antenna device in preferred embodiment 20, and in FIG. 18A, an electrical length of about ⅛ wavelength from the end portion of the first radiation plate 2 is composed of a first base element 16, and other region is composed of a second base element 17, and the first radiation plate 2 is provided on the top of the first base element 16 and second base element 17, and a ground pattern 18 is provided on the bottom of the first base element 16 and second base element 17, while a first power feed port 4 and a second power feed port 5 are provided at the side of the first base element 16.

What must be noted here is that the materials should be selected so that the value of dividing the relative permeability by the dielectric constant of the first base element 16 be smaller than the value of the second base element 17. When the antenna device is composed of the first base element 16 and second base element 17 assuring such relation, the size of the radiation plate can be reduced by the principle of the resonator of SIR structure.

FIG. 18B shows an preferred embodiment of diversity antenna using the antenna shown in FIG. 18A. The antenna shown in FIG. 18A is mounted on the ground plate 1 so as to satisfy the configuration shown in preferred embodiment 4, and power is supplied from a high frequency circuit 19 to each power feed port by way of strip lines and through-holes in the back of a mounting board 20.

Preferred Embodiment 21

Figure 19A:
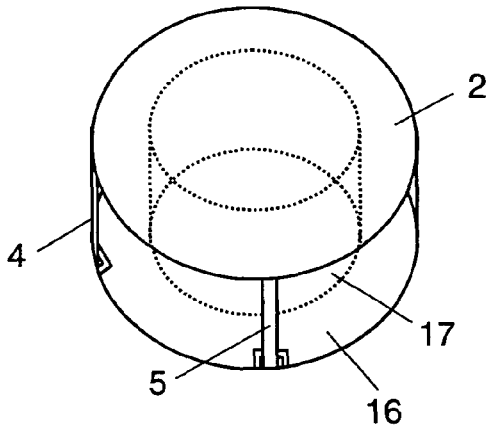
FIG. 19A is a perspective view of an antenna device in preferred embodiment 21.
Figure 19B:
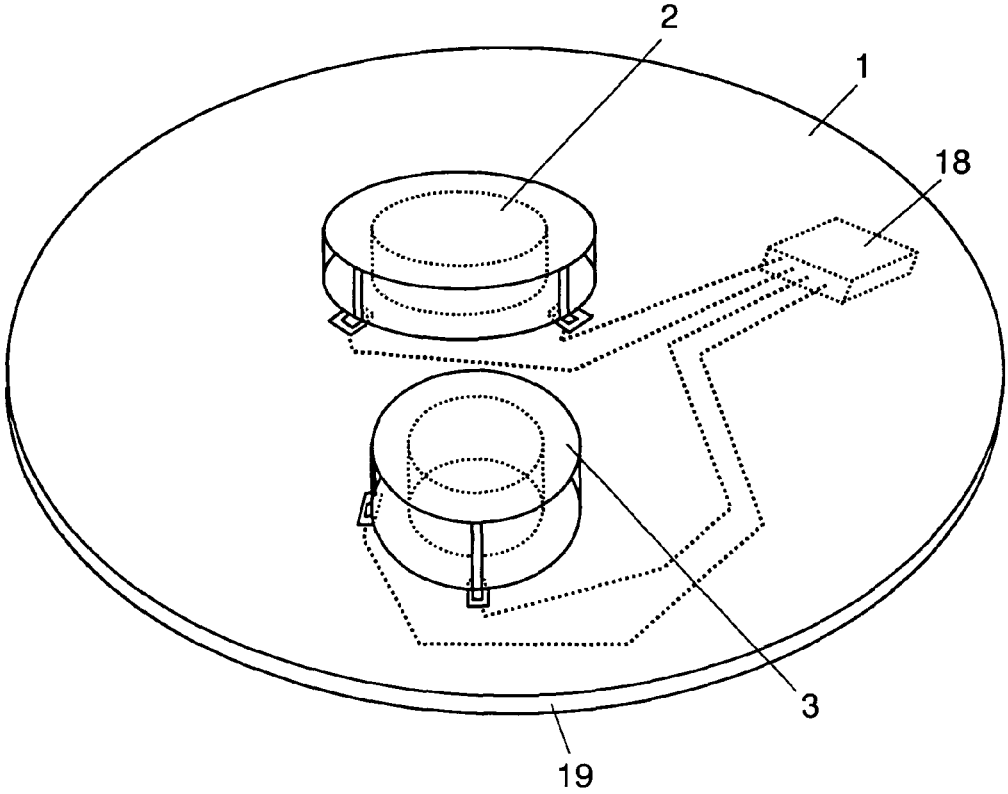
FIG. 19B is a perspective view of the antenna device in preferred embodiment 21.

FIG. 19A and FIG. 19B show an antenna device in preferred embodiment 21, and in FIG. 19A, on a straight line linking power feed ports 4, 5 and the middle point of first radiation plate 2, an electrical length of about ⅛ wavelength from the end portion of the first radiation plate 2 is composed of a first base element 16, and another region is composed of a second base element 17, and the first radiation plate 2 is provided on the top of the first base element 16 and second base element 17, and a ground pattern 18 is provided on the bottom of the first base element 16 and second base element 17, while the first power feed port 4 and second power feed port 5 are provided at the side of the first base element 16.

Same effects as in preferred embodiment 20 are obtained.

Preferred Embodiment 22

Figure 20A:
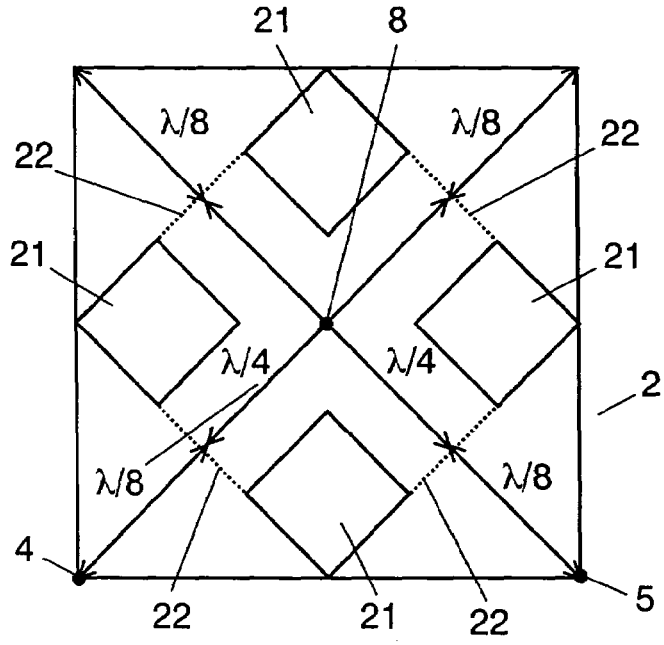
FIG. 20A is a top view of an antenna device in preferred embodiment 22.
Figure 20B:
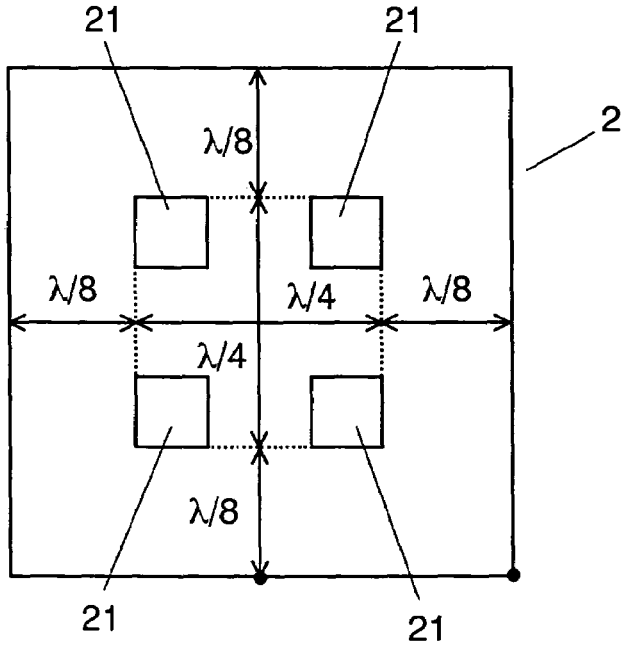
FIG. 20B is a top view when the position of the power feeder of the same antenna device is changed.

FIG. 20A and FIG. 20B show an antenna device in preferred embodiment 22, and in FIG. 20A, four square slits 21 are provided in a first radiation plate 2 so as to be line symmetrical to a first straight line 10 and a second straight line 11 linking a first power feed port 4 and a second power feed port 5 and a first middle point 8, and a sixth straight line 22 orthogonal to each straight line at a position of about ⅛ wavelength in electrical length from the end portion of the first radiation plate 2 and two sides of the four square slits 21 contact with each other on the first straight line 10 and second straight line 11.

Having such structure, since the line width of the region of ⅛ wavelength from the end portion of the radiation plate can be designed wider as compared with another region, the capacity value between the ground plate and radiation plate can be increased, and the characteristic impedance in this region can be set low. On the other hand, since the line width in other than the region of ⅛ wavelength from the end portion of the radiation plate is narrow, and the capacity value between the ground plate and radiation plate is small, and the inductance value is larger, so that the characteristic impedance can be set larger. That is, since the characteristic impedance can be varied largely at a point of ⅛ wavelength from the end portion of the radiation plate, the size of the radiation plate can be reduced according to the principle of the resonator of SIR structure.

FIG. 20B shows the shape of the radiation plate when the positions of the power feed ports in FIG. 20A are changed from the corners of the square of the radiation plate 2 to the middle of end sides. In FIGS. 20A and 20B, the radiation plate of square shape is explained, but same effects are obtained by the radiation plate 2 of circular shape.

Preferred Embodiment 23

Figure 21A:
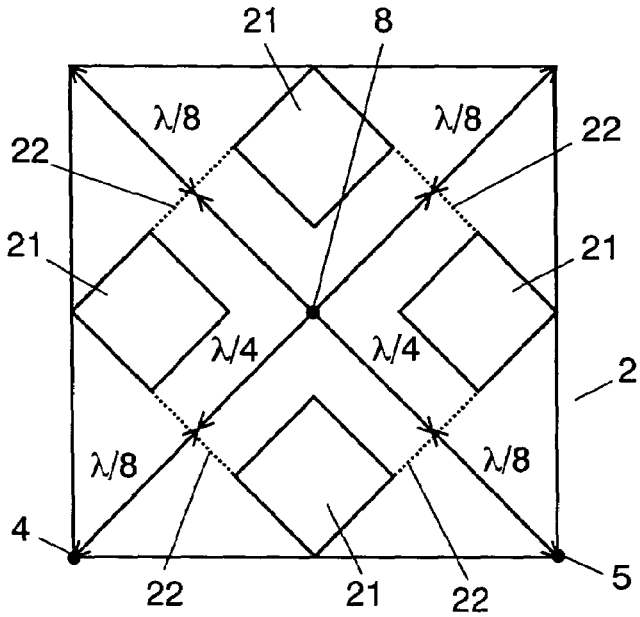
FIG. 21A is a top view of an antenna device in preferred embodiment 23.
Figure 21B:
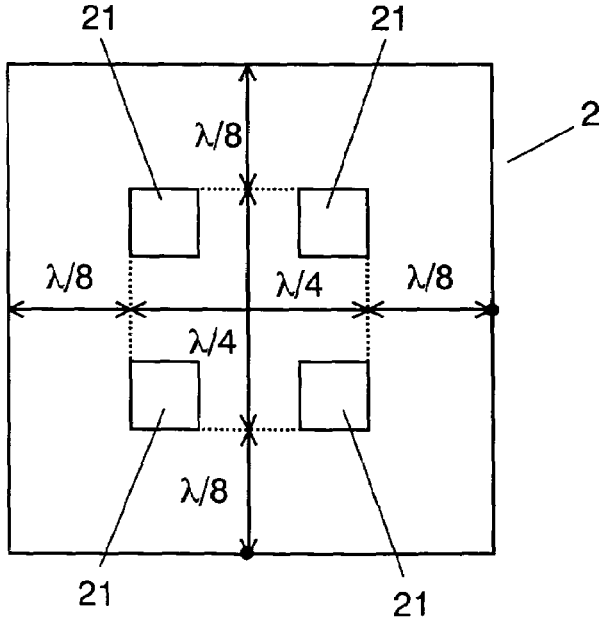
FIG. 21B is a top view when the position of the power feeder of the antenna device in preferred embodiment 23 is changed.

FIG. 21A and FIG. 21B show an antenna device in preferred embodiment 23, and in FIG. 21A, four square slits 21 are provided in a first radiation plate 2 so as to be line symmetrical to a first straight line 10 and a second straight line 11 linking a first power feed port 4 and a second power feed port 5 and a first middle point 8, and a sixth straight line 22 orthogonal to each straight line at a position of about ⅛ wavelength in electrical length from the end portion of the first radiation plate 2 and two sides of the four square slits 21 contact with each other on the first straight line 10 and second straight line 11. Since the line width along the first straight line 10 and second straight line 11 varies largely at a point of ⅛ wavelength from the end portion of the radiation plate, the size of the radiation plate can be reduced according to the principle of the resonator of SIR structure.

FIG. 21B shows the shape of the radiation plate when the positions of the power feed ports in FIG. 21A are changed from the corners of the square of the radiation plate 2 to the middle of end sides. In FIGS. 21A and 21B, the radiation plate 2 of square shape is explained, but same effects are obtained by the radiation plate of circular shape.

Preferred Embodiment 24

Figure 22A:
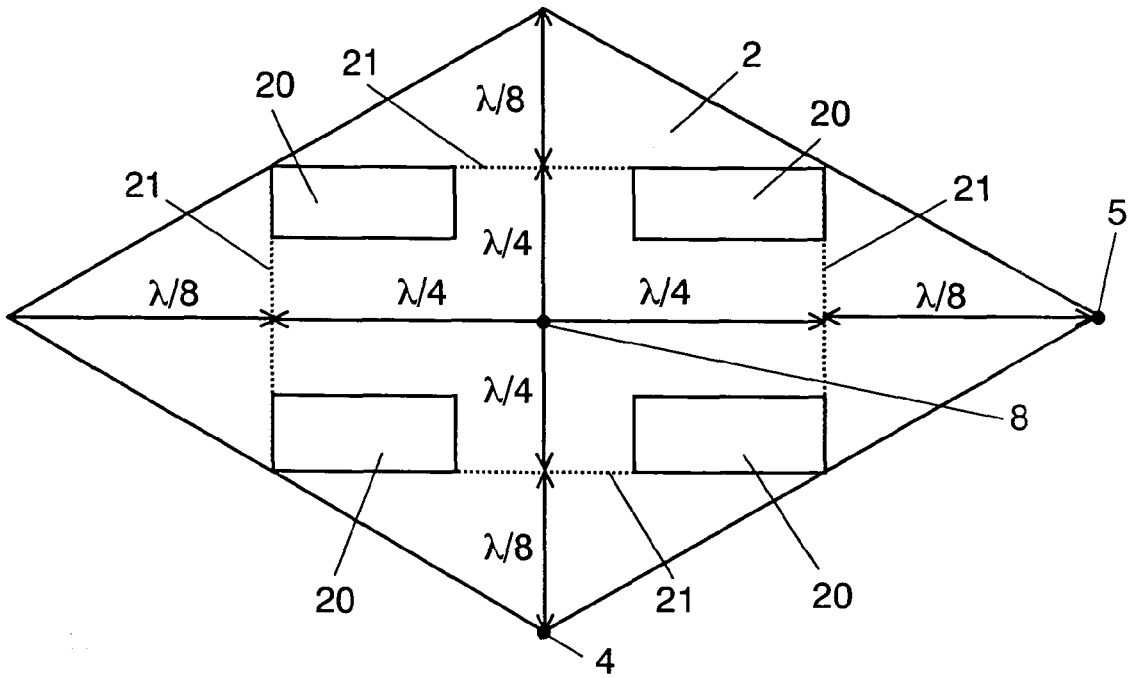
FIG. 22A is a top view of an antenna device in preferred embodiment 24.
Figure 22B:
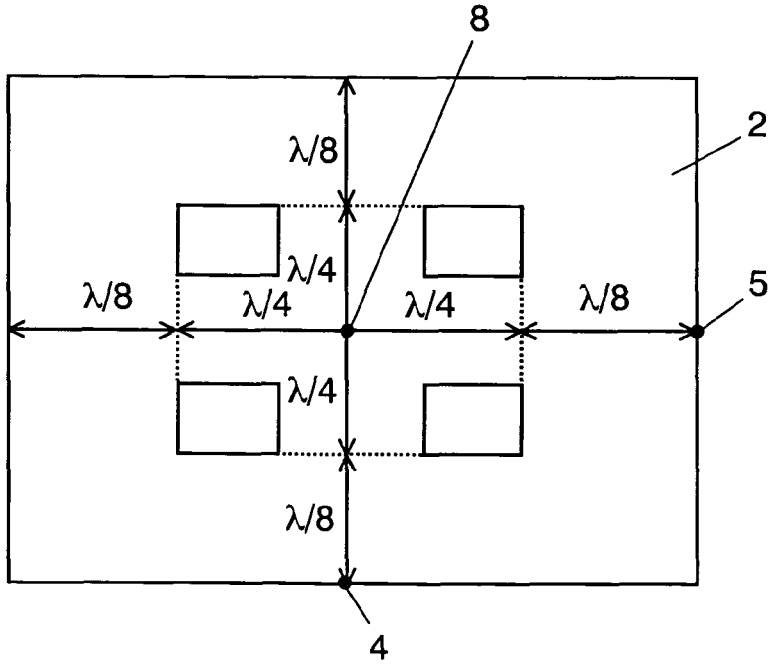
FIG. 22B is a top view of the antenna device in preferred embodiment 24.

FIG. 22A and FIG. 22B show an antenna device in preferred embodiment 24, and in FIG. 22A, four square slits 20 are provided in a first radiation plate 2 so as to be line symmetrical to a first straight line 10 and a second straight line 11 linking a first power feed port 4 and a second power feed port 5 and a first middle point 8, and a fifth straight line 22 orthogonal to each straight line at a position of about ⅛ wavelength in electrical length from the end portion of the first radiation plate 2 and two sides of the four square slits 20 contact with each other on the first straight line 10 and second straight line 11.

Same effects as in preferred embodiment 23 are obtained.

Preferred Embodiment 25

Figure 23A:
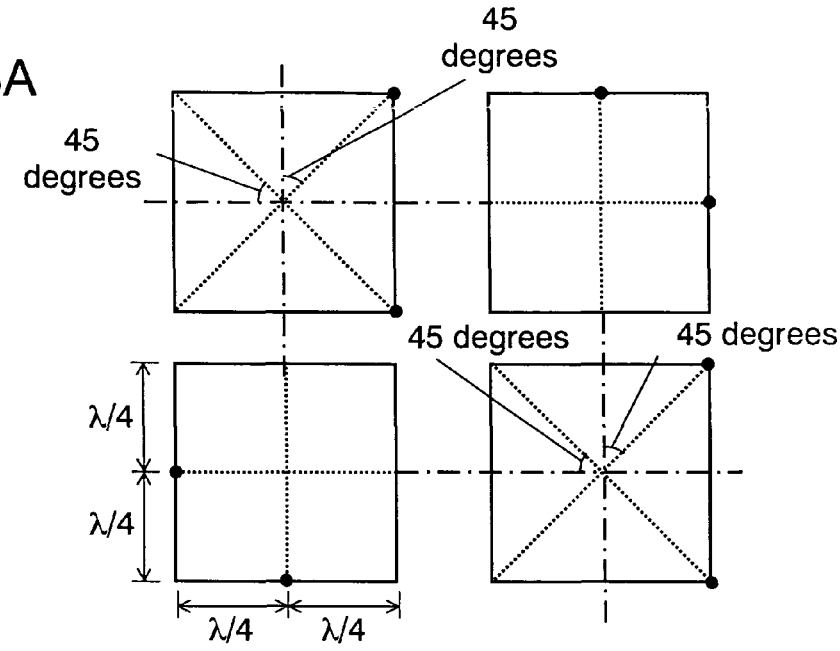
FIG. 23A is a top view of an antenna device in preferred embodiment 25.
Figure 23B:
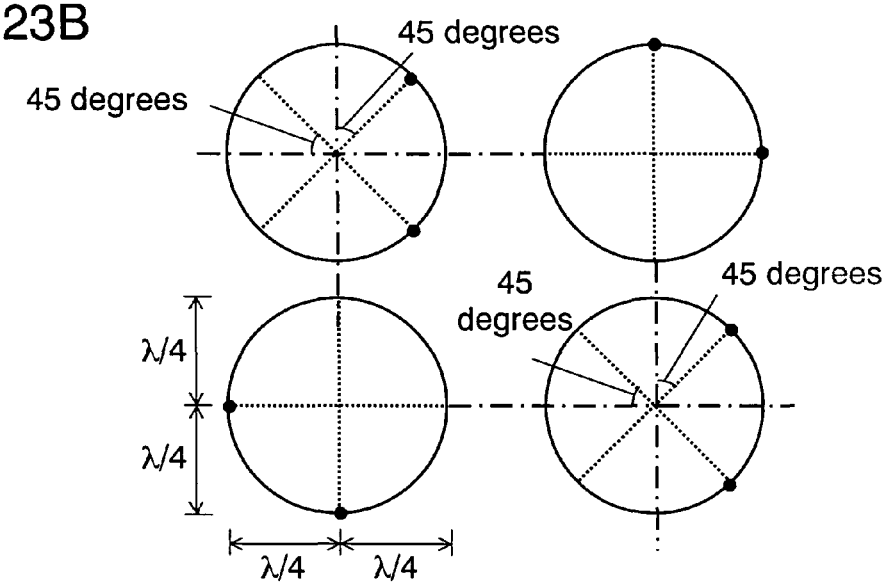
FIG. 23B is a top view when the radiation plate of the same antenna device is changed in a circular shape.

FIG. 23A and FIG. 23B show an antenna device in preferred embodiment 25, and FIG. 23A shows the number of radiation plates is increased from two to four while maintaining the configuration of the first straight line 10, second straight line 11, third straight line 12 and fourth straight line 13 same shown in preferred embodiment 4 in the adjacent radiation plates. Also, while maintaining the configuration of straight lines in preferred embodiment 9, a diversity antenna can be realized by using five or more radiation plates. FIG. 23B shows the shape of radiation plates in FIG. 23A is changed from square shape to circular shape, and same effects as in FIG. 23A are obtained.

Preferred Embodiment 26

Figure 24:
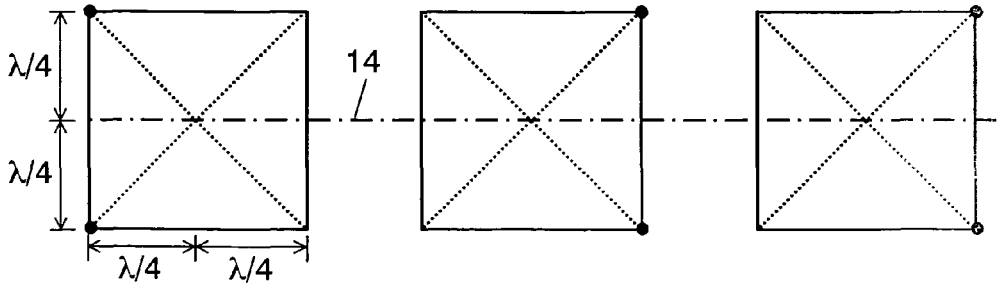
FIG. 24 is a top view of an antenna device in preferred embodiment 26.

FIG. 24 shows an antenna device in preferred embodiment 26, and FIG. 24 shows a diversity antenna having radiation plates arranged so that the middle point of two power feed ports of each radiation plate and a fifth straight line 14 linking the middle point of radiation plate may be present on a same straight line, and the isolation between power feed ports can be enhanced same as in preferred embodiment 5. In preferred embodiment 26, the antenna device is composed of radiation plates of square shape, but same effects are obtained by using radiation plates of circular shape.

Preferred Embodiment 27

Figure 26A:
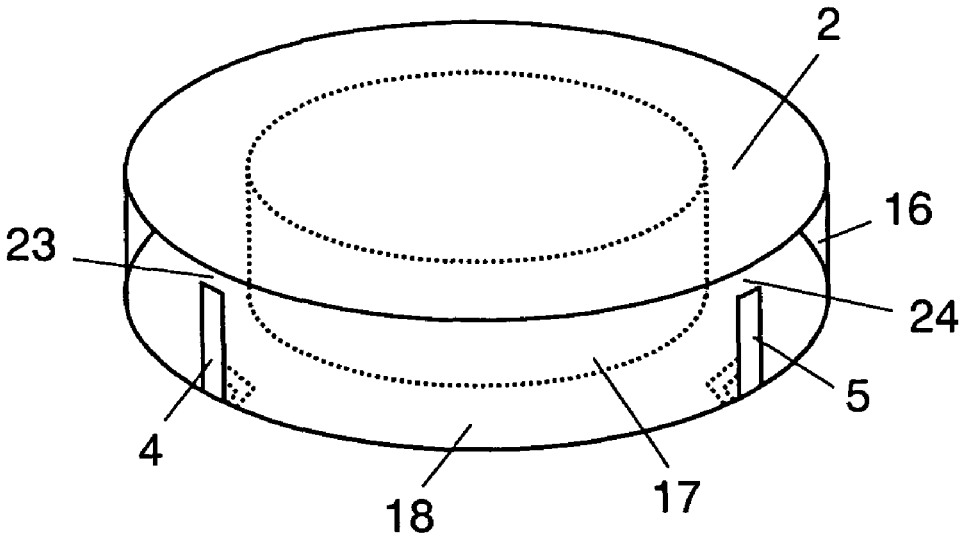
FIG. 26A is a perspective view of an antenna device in preferred embodiment 27, 28 or 29.
Figure 26B:
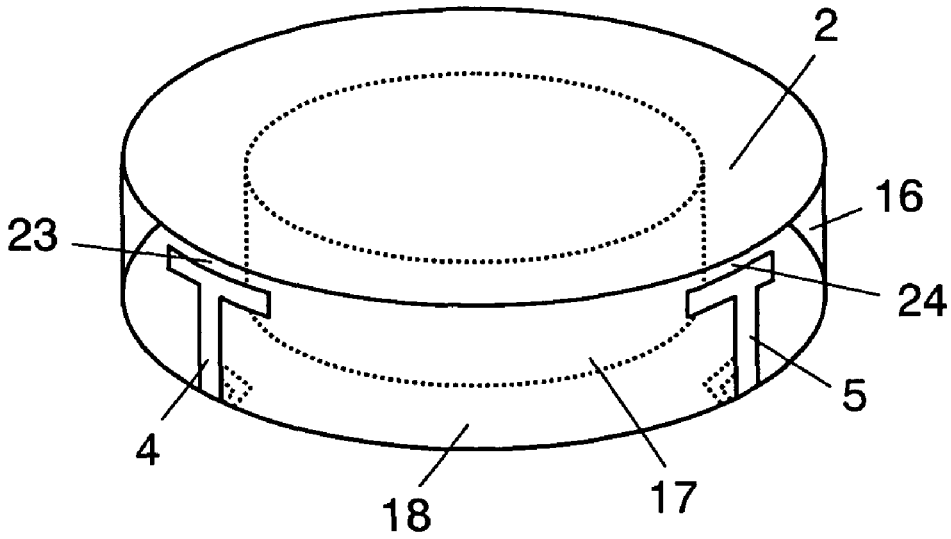
FIG. 26B is a perspective view of the second antenna device of the same.

FIG. 26A and FIG. 26B show an antenna device in preferred embodiment 27, and FIG. 26A shows a first gap 23 and a second gap 24 are provided in the first power feed port 4, second power feed port 5 and first radiation plate 2 of the antenna device shown in preferred embodiment 20. By adjusting the gap width of the first gap 23 and second gap 24, the impedance of the first power feed port 4 and second power feed port 5 can be matched, and a matching circuit is not needed, and hence the cost is saved, the size is reduced, and a high gain is obtained. Besides, as shown in FIG. 26B, by extending the lateral width of the first gap 23 and second gap 24, the generated capacity value is increased by the gaps, so that the impedance adjustment range can be widened.

Preferred Embodiment 28

FIG. 26A and FIG. 26B show an antenna device in preferred embodiment 28, and FIG. 26A shows a first gap 23 and a second gap 24 are provided in the first power feed port 4, second power feed port 5 and first radiation plate 2 of the antenna device shown in preferred embodiment 20.

Same effects as in preferred embodiment 27 are obtained.

Preferred Embodiment 29

FIG. 26A and FIG. 26B show an antenna device in preferred embodiment 29, and FIG. 26A shows a first gap 23 and a second gap 24 are provided in the first power feed port 4, second power feed port 5 and first radiation plate 2 of the antenna device of preferred embodiment 21 shown in FIG. 19A.

Same effects as in preferred embodiment 27 are obtained.

Preferred Embodiment 30

Figure 25A:
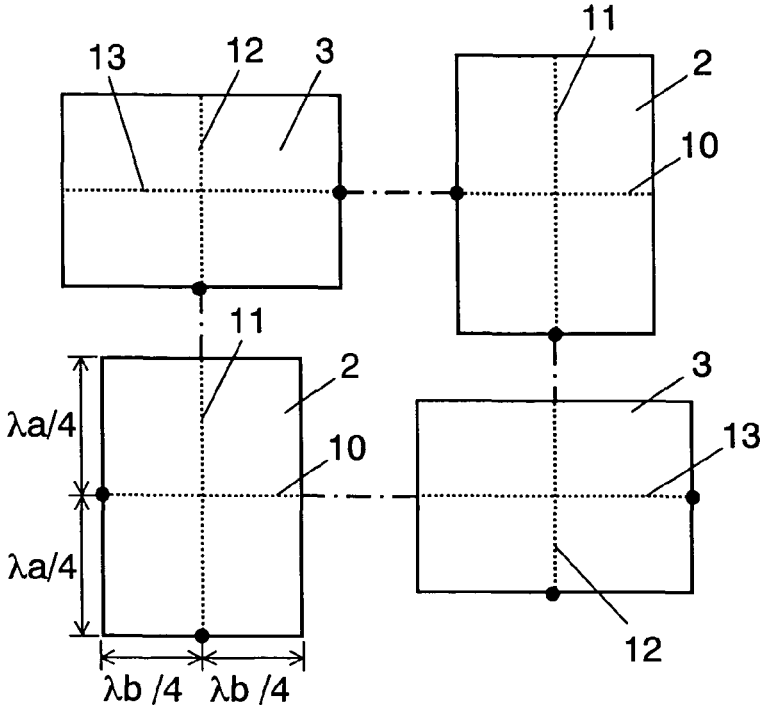
FIG. 25A is a top view of an antenna device in preferred embodiment 30.
Figure 25B:
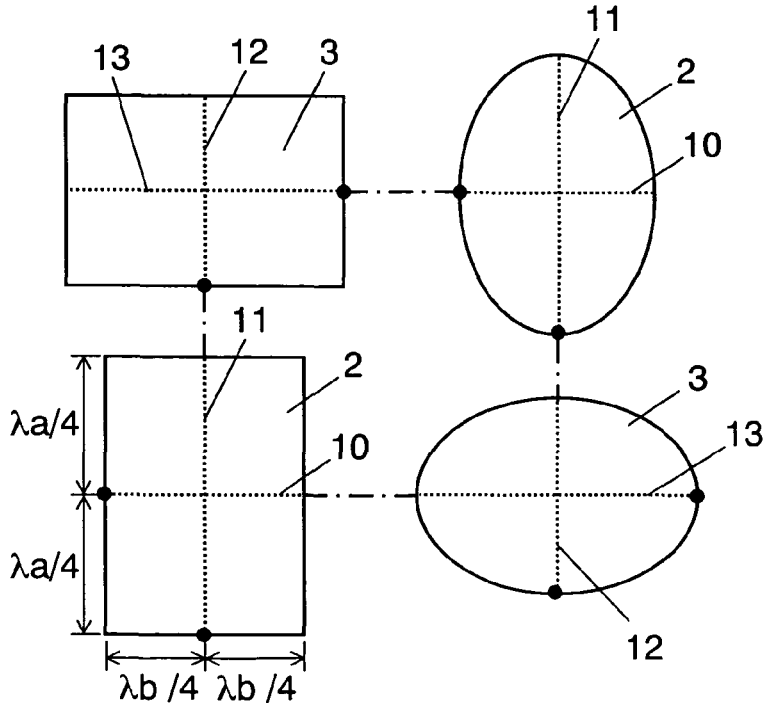
FIG. 25B is a top view of the antenna device in preferred embodiment 30.

FIG. 25A and FIG. 25B show an antenna device in preferred embodiment 30, and FIG. 25A shows the number of radiation plates is increased from two to four while maintaining the configuration of the first straight line 10, second straight line 11, third straight line 12 and fourth straight line 13 the same as shown in preferred embodiment 3 in the adjacent radiation plates 2, 3. Also, while maintaining the same configuration, a diversity antenna can be realized by using five or more radiation plates. FIG. 25B shows the shape of radiation plates in FIG. 25A is changed from rectangular shape to elliptical shape, and same effects as in FIG. 25A are obtained.

Preferred Embodiment 31

Figure 12:
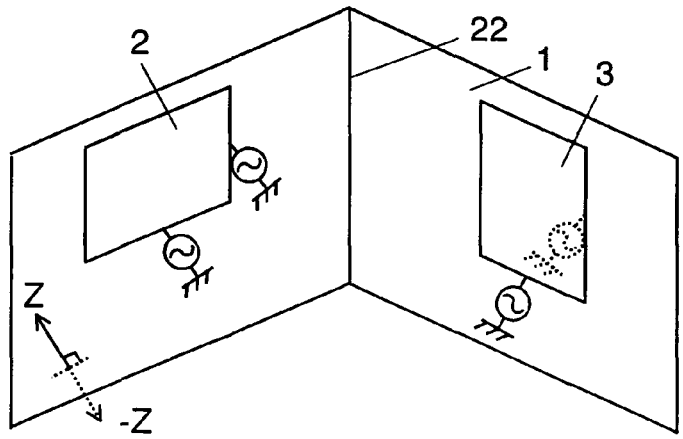
FIG. 12 is a perspective view of an antenna device in preferred embodiment 31.

FIG. 12 shows an antenna device in preferred embodiment 31, and preferred embodiment 31 has a structure in which the ground plate 1 is bent by a ground flexure 22 between a first radiation plate 2 and a second radiation plate 3. Since the radiation gain of the first radiation plate 2 in the −Z direction is small, according to preferred embodiment 31 in which the second radiation plate 3 is disposed in the −Z direction on a horizontal plane of the ground plate 1 opposite to the first radiation plate 2, the isolation between the ports can be further increased, and the effects of the diversity antenna can be enhanced. In preferred embodiment 31, the radiation plates are formed in rectangular shape, but same effects are obtained in radiation plates in elliptical shape.

Thus, according to the invention, by effectively disposing plural antennas having two power feed ports of assured isolation, an antenna device of small size and great diversity effect can be realized.

What is claimed is:

1. An antenna device comprising:

a ground plate;

a first radiation plate having a diameter, a side length or a diagonal length of about ½ wavelength in electrical length disposed at a distance from the ground plate; and a second radiation plate having a diameter, a side length or a diagonal length of about ½ wavelength in electrical length disposed at a distance from the ground plate, wherein the first radiation plate has a first power feed port and a second power feed port provided thereon, the first and second power feed ports being disposed so that straight lines linking a position of each of the first and second power feed ports and a middle point of the first radiation plate are orthogonal to each other, the second radiation plate has a third power feed port and a fourth power feed port provided thereon, the third and fourth power feed ports being disposed so that straight lines linking a position of each of the third and fourth power feed ports and a middle point of the second radiation plate are orthogonal to each other, and the orthogonal straight lines of the first radiation plate are rotated at an angle of 45 degrees with respect to the orthogonal straight lines of the second radiation plate.

2. The antenna device of claim 1, wherein the first and second radiation plates are nearly circular and each has the diameter of about ½ wavelength in electrical length.

3. The antenna device of claim 1, wherein the first and second radiation plates are nearly square and each has the side length or the diagonal length of about ½ wavelength in electrical length.

4. The antenna device of claim 1, wherein the ground plate is bent along a straight line located between the first and second radiation plates.

5. The antenna device of claim 1, wherein the distance between the ground plate and a region of about ⅛ wavelength in electrical length from an end portion of each of the first and second radiation plates is smaller than the distance from the ground plate to other regions of the first and second radiation plates.

6. The antenna device of claim 1, wherein the first and second radiation plates each comprise a first base element at a region of about ⅛ wavelength in electrical length from an end portion thereof and a second base element at other regions thereof, and a value obtained by dividing a relative permeability by a dielectric constant of the first base element between the ground plate and the first and second radiation plates is smaller than a value obtained by dividing a relative permeability by a dielectric constant of the second base element.

7. The antenna device of claim 1, wherein the orthogonal straight lines of the first and second radiation plates divide each of the first and second radiation plates into four symmetrical quadrants, each of the four symmetrical quadrants of each of the first and second radiation plates includes a square slit, each of the square slits has a pair of opposing sides parallel to each of the orthogonal straight lines of the respective first or second radiation plate, and each of the square slits has two adjacent sides, each of the two adjacent sides being located on a line perpendicular to one of the orthogonal straight lines and intersecting the one of the orthogonal straight lines at a position about ⅛ wavelength in electrical length from an end portion of the respective first or second radiation plate.

8. The antenna device of claim 1, wherein a first system includes the first power feed port and the second power feed port, and a second system includes the third power feed port and the fourth power feed port.

9. The antenna device of claim 1, wherein a first system includes the first power feed port and the third power feed port, and a second system includes the second power feed port and the fourth power feed port.

10. The antenna device of claim 1, wherein the first, second, third and fourth power feed ports are each respectively connected to one of the first and second radiation plates by way of gaps.

11. The antenna device of claim 1, further comprising at least one additional radiation plate as a third radiation plate, wherein the third radiation plate has a diameter, a side length or a diagonal length of about ½ wavelength in electrical length disposed at a distance from the ground plate, the third radiation plate has a fifth power feed port and a sixth power feed port, the fifth power feed port and the sixth power feed port being disposed so that straight lines linking a position of each of the fifth and sixth power feed points and a middle point of the third radiation plate are orthogonal to each other, and the first and second radiation plates are adjacent to each other, the third radiation plate is adjacent to one of the first and second radiation plates, and the orthogonal straight lines of the third radiation plate are rotated at an angle of 45 degrees with respect to the orthogonal straight lines of the adjacent one of the first and second radiation plates.

12. An antenna device comprising:

a ground plate;

a first radiation plate having a diameter, a side length or a diagonal length of about ½ wavelength in electrical length disposed at a distance from the ground plate; and a second radiation plate having a diameter, a side length or a diagonal length of about ½ wavelength in electrical length disposed at a distance from the ground plate, wherein the first radiation plate has a first power feed port and a second power feed port provided thereon, the first and second power feed ports being disposed so that straight lines linking a position of each of the first and second power feed ports and a middle point of the first radiation plate are orthogonal to each other, the second radiation plate has a third power feed port and a fourth power feed port provided thereon, the third and fourth power feed ports being disposed so that straight lines linking a position of each of the third and fourth power feed ports and a middle point of the second radiation plate are orthogonal to each other, and the first and second radiation plates are positioned with respect to each other so that another straight line one of (a) links a middle point between the first and second power feed ports, the middle points of the first and second radiation plates, and a middle point between the third and fourth power feed ports, and (b) links the middle point of the first and second radiation plates and is parallel to a straight line passing through the positions of the first and second power feed ports and a straight line passing through the positions of the third and forth power feed ports.

13. The antenna device of claim 12, wherein the first and second radiation plates are positioned with respect to each other so that the other straight line (a) links the middle point between the first and second power feed ports the middle points of the first and second radiation plates and the middle point between the third and fourth power feed ports.

14. The antenna device of claim 12, wherein the first and second radiation plates are nearly circular and each has the diameter of about ½ wavelength in electrical length.

15. The antenna device of claim 12, wherein the first and second radiation plates are nearly square and each has the side length or the diagonal length of about ½ wavelength in electrical length.

16. The antenna device of claim 12, wherein the ground plate is bent alone a straight line located between the first and second radiation plates.

17. The antenna device of claim 12, wherein the distance between the ground plate and a region of about ⅛ wavelength in electrical length from an end portion of each of the first and second radiation plates is smaller than the distance from the ground plate to other regions of the first and second radiation plates.

18. The antenna device of claim 12, wherein the first and second radiation plates each comprise a first base element at a region of about ⅛ wavelength in electrical length from an end portion thereof and a second base element at other regions thereof, and a value obtained by dividing a relative permeability by a dielectric constant of the first base element between the ground plate and the first and second radiation plates is smaller than a value obtained by dividing a relative permeability by a dielectric constant of the second base element.

19. The antenna device of claim 12, wherein the orthogonal straight lines of the first and second radiation plates divide each of the first and second radiation plates into four symmetrical quadrants, each of the four symmetrical quadrants of each of the first and second radiation plates includes a square slit, each of the square slits has a pair of opposing sides parallel to each of the orthogonal straight lines of the respective first or second radiation plate, and each of the square slits has two adjacent sides, each of the two adjacent sides being located on a line perpendicular to one of the orthogonal straight lines and intersecting the one of the orthogonal straight lines at a position about ⅛ wavelength in electrical length from an end portion of the respective first or second radiation plate.

20. The antenna device of claim 12, wherein a first system includes the first power feed port and the second power feed port, and a second system includes the third power feed port and the fourth power feed port.

21. The antenna device of claim 12, wherein a first system includes the first power feed port and the third power feed port, and a second system includes the second power feed port and the fourth power feed port.

22. The antenna device of claim 12, wherein the first, second, third and fourth power feed ports are each respectively connected to one of the first and second radiation plates by way of gaps.

23. An antenna device comprising:

a ground plate;

a first radiation plate having a diameter, a side length or an axial length of about ½ wavelength in electrical lengths disposed at a distance from the ground plate; and a second radiation plate having a diameter, a side length or an axial length of about ½ wavelength in electrical length disposed at a distance from the ground plate, wherein the first radiation plate has a first power feed port and a second power feed port provided in a peripheral area thereof, a first straight line linking a position of the first power feed port and a middle point of the first radiation plate being orthogonal to a second straight line linking a position of the second power feed port and the middle point of the first radiation plate, the second radiation plate has a third power feed port and a fourth power feed port provided thereon, a third straight line linking a position of the third power feed port and a middle point of the second radiation plate being orthogonal to a fourth straight line linking a position of the fourth power feed port and the middle point of the second radiation plate, and an electrical length of the first straight line and an electrical length of the third straight line are identical in length, an electrical length of the second straight line and an electrical length of the fourth straight line are identical in length, the electrical length of the first straight line and the electrical length of the second straight line are different in length, and the first straight line and the third straight line or the second straight line and the fourth straight line are present on different lines.

24. The antenna device of claim 23, further comprising at least one additional radiation plate.

25. The antenna device of claim 23, wherein the first and second radiation plates are elliptical and each has one of a major axis and a minor axis with the axial length of about ½ wavelength in electrical length.

26. The antenna device of claim 23, wherein the first and second radiation plates are rectangular and each has one of a major axis and a minor axis with the axial length of about ½ wavelength in electrical length.

27. The antenna device of claim 23, wherein longer sides or major axes of the first and second radiation plates cross each other orthogonally.

28. The antenna device of claim 23, wherein the first and second radiation plates have a shape in which a gap between the ground plate and each of the first and second radiation plates is wider at a position of about ⅛ wavelength in electrical length from end portions of the first and second radiation plates on straight lines linking each of the first, second, third and fourth power feed ports and the respective middle point of the first and second radiation plates.

29. The antenna device of claim 23, wherein the first and second radiation plates each comprise a base element, and a value obtained by dividing a relative permeability by a dielectric constant of the base element between the ground plate and each of the first and second radiation plates is larger at a position of about ⅛ wavelength in electrical length from end portions of the first and second radiation plates on straight lines linking each of the first, second, third and fourth power feed ports and the respective middle point of the first and second radiation plates.

30. The antenna device of claim 23, wherein the first and second straight lines divide the first radiation plate into four symmetrical quadrants, the third and fourth straight lines divide the second radiation plate into four symmetrical quadrants, each of the four symmetrical quadrants of the first and second radiation plates includes a square slit, each of the square slits of the first radiation plate has two opposing sides parallel to the first straight line and two opposing sides parallel to the second straight line, each of the square slits of the second radiation plate has two opposing sides parallel to the third straight line and two opposing sides parallel to the fourth straight line, each of the square slits of the first radiation plate has two adjacent sides, one of the two adjacent sides being located on a line perpendicular to the first straight line and intersecting the first straight line at a position point about ⅛ wavelength in electrical length from an end portion of the first radiation plate and another of the two adjacent sides being located on a line perpendicular to the second straight line and intersecting the second straight line at a position about ⅛ wavelength in electrical length from an end portion of the first radiation plate, and each of the square slits of the second radiation plate has two adjacent sides, one of the two adjacent sides being located on a line perpendicular to the third straight line and intersecting the third straight line at a position about ⅛ wavelength in electrical length from an end portion of the second radiation plate and another of the two adjacent sides being located on a line perpendicular to the fourth straight line and intersecting the fourth straight line at a position about ⅛ wavelength in electrical length from an end portion of the second radiation plate.

31. The antenna device of claim 23, wherein the ground plate is bent along a straight line located between the first and second radiation plates.

32. The antenna device of claim 23, wherein the first power feed port and the third power feed port are connected to a high frequency circuit in a first system, and the second power feed port and the fourth power feed port are connected to a high frequency circuit in a second system.

33. The antenna device of claim 23, wherein the first power feed port and the third power feed port are connected to a reception circuit, and the second power feed port and the fourth power feed port are connected to a transmission circuit.

34. The antenna device of claim 23, wherein the first, second, third and fourth power feed ports are each respectively connected to one of the first and second radiation plates by way of gaps.

* * * * *